US007980425B2

(12) United States Patent
Baron et al.

(10) Patent No.: US 7,980,425 B2
(45) Date of Patent: Jul. 19, 2011

(54) METERING PUMP FOR DISPENSING LIQUID

(75) Inventors: Richard D. Baron, Zephyrhills, FL (US); Steven A. Garbee, Brandon, FL (US); Valdemiro M. Quadros, Zephyrhills, FL (US); Alan Lee Hackey, Zephyrhills, FL (US)

(73) Assignee: Nestec S.A. (CH)

( * ) Notice: Subject to any disclaimer, the term of this patent is extended or adjusted under 35 U.S.C. 154(b) by 850 days.

(21) Appl. No.: 11/985,621

(22) Filed: Nov. 16, 2007

(65) Prior Publication Data

US 2008/0118378 A1 May 22, 2008

Related U.S. Application Data

(60) Provisional application No. 60/999,884, filed on Oct. 22, 2007, provisional application No. 60/859,672, filed on Nov. 16, 2006.

(51) Int. Cl.
*B65D 37/00* (2006.01)

(52) U.S. Cl. ..... 222/214; 222/333; 137/256; 251/7; 417/480

(58) Field of Classification Search ..... 222/207, 222/209–214, 386, 333; 251/4–7; 137/256; 417/480

See application file for complete search history.

(56) References Cited

U.S. PATENT DOCUMENTS

| | | | | |
|---|---|---|---|---|
| 2,647,661 | A * | 8/1953 | Harvey | 222/68 |
| 3,768,704 | A | 10/1973 | Beguin | |
| 4,014,318 | A | 3/1977 | Dockum et al. | |
| 4,130,224 | A * | 12/1978 | Norman et al. | 222/207 |
| 4,165,954 | A | 8/1979 | Amos | |
| 4,722,372 | A | 2/1988 | Hoffman et al. | |
| 4,967,940 | A | 11/1990 | Blette et al. | |
| 5,217,355 | A | 6/1993 | Hyman et al. | |
| 5,252,044 | A | 10/1993 | Raines et al. | |
| 5,255,822 | A | 10/1993 | Mease et al. | |
| 5,316,452 | A | 5/1994 | Bogen et al. | |
| 5,402,913 | A | 4/1995 | Graf | |
| 5,593,290 | A | 1/1997 | Greisch et al. | |
| 5,964,583 | A | 10/1999 | Danby | |
| 6,213,739 | B1 | 4/2001 | Phallen et al. | |

* cited by examiner

*Primary Examiner* — Kevin P Shaver
*Assistant Examiner* — Melvin A Cartagena
(74) *Attorney, Agent, or Firm* — Frijouf, Rust & Pyle, P.A.

(57) ABSTRACT

A pump for metering a liquid is disclosed comprising a flexible tube connected to a container with a pressure relief valve located in the flexible tube. A housing defines an aperture for receiving the flexible tube with a compression surface located adjacent to the aperture. A reciprocating member has a sealing element and a pumping element. A drive moves the sealing element for pinching the flexible tube against the compression surface upstream from the pressure relief valve for trapping liquid between the sealing element and the pressure relief valve. The drive moves the pumping element for collapsing the flexible tube against the compression surface for pumping the trapped liquid to discharge a metered quantity of the liquid from the pressure relief valve.

15 Claims, 17 Drawing Sheets

METERING PUMP FOR DISPENSING LIQUID

CROSS-REFERENCE TO RELATED APPLICATIONS

This application claims benefit of U.S. provisional application Ser. No. 60/999,884 filed Oct. 22, 2007 and U.S. provisional application Ser. No. 60/859,672 filed Nov. 16, 2006. All subject matter set forth in U.S. provisional application Ser. No. 60/999,884 filed Oct. 22, 2007 and U.S. provisional application Ser. No. 60/859,672 filed Nov. 16, 2006 is hereby incorporated by reference into the present application as if fully set forth herein.

BACKGROUND OF THE INVENTION

1. Field of the Invention

This invention relates to the pumping of liquids and more particularly to an improved pump for metering a liquid from a container.

2. Description of the Related Art

Metering pumps have been well known in the art for pumping and/or dispensing a specific volume of liquid from a container. There are two basic types of metering pumps namely a single action metering pump and a multiple action metering pump. In a single action metering pump, the liquid is pumped and dispensed in a single action or single stroke of the metering pump. Typically, a volume is filled with a metered volume of liquid from a larger container and then the metered volume of liquid is pumped or discharged from the metered volume for end use.

In a multiple action metering pump, a volume is filled with their metered volume of liquid from a larger container and then the body of liquid is pumped or discharged from the metered volume. Thereafter, the volume is filled again with a metered volume of liquid from a large container and is again pumped or discharged to from the metered volume. The multiple action metering pump has the advantage of being able to discharge greater volumes of metered liquid over the single action metering pump. However, it is more difficult to accurately discharge a metered amount of liquid from a multiple action metering pump than a single action metering pump.

In some cases, a metering pump is used for metering a liquid concentrate for subsequent mixing with a liquid diluent. The accuracy of a metering pump is critical when the liquid concentrate is a highly concentrated liquid. The following United States patents are representative of the attempts of the prior art to provide accurate metering pumps.

U.S. Pat. No. 3,768,704 to Beguin discloses a fluid dispenser comprising a pressurized fluid reservoir connected to one end of which is a flexible flattenable tube the other end of which forms a dispensing outlet. The tube is supported intermediate its ends by an upstream and a downstream support of a frame the section of the tube between these supports being of greater length than the spacing between these supports and being a floating section movable in a space provided by the frame. The floating section can occupy a position in which a major portion thereof extending from the upstream support is inflated by the pressurized fluid and is sealed at its downstream end by a fold in the tube and can be moved from this position by a roller movable in said space in such a way as first to form a fold near the upstream end of the free section sealing a body of fluid in the tube and then to displace the inflated section to open out the folds at the downstream end of the free section to allow the body of fluid to pass from the dispensing outlet of the tube. The roller in the final stages of its dispensing movement stretches the free section of the tube over a convex surface to expel the fluid from the tube. During return movement of the roller the free section of tube is sealed adjacent its downstream end before the tube is again inflated.

U.S. Pat. No. 4,014,318 to Dockum, et al. discloses a circulatory assist device and system for controlling, wholly or partially, the pumping of blood through a blood vessel or vascular prosthesis. The assist device is comprised of an electrically operated plunger, or equivalent, which momentarily occludes the blood vessel to effect pumping. Preferably, a plurality of the assist devices are mounted adjacent each other and are sequentially actuated to sequentially occlude adjacent segments of the associated blood vessel, thereby creating a pumping action. The assist devices are implantable at various locations in the body and may be provided in appropriate size and number to effectively replace heart action. Valves may be utilized to enhance the efficiency or provide pumping with a single assist device.

U.S. Pat. No. 4,165,954 to Amos discloses a linear peristaltic pump. The pump includes a pivotal pump arm and a flexible tube secured thereto to inhibit longitudinal tube movement. A means for applying a force to such arm, such as a spring, is provided to cause the pump arm to pivot. A stop device is disposed in the path of travel of the pump arm so that the pump arm pivotal travel may be terminated as the pump arm comes to rest against such stop device. The flexible tube is disposed adjacent to a surface of the pump arm and is pivotal therewith so that the flexible tube is pinched off between the pump arm surface and the stop device as the pump comes to rest against it. A rotatable roller assembly is provided having at least one roller mounted on a rotatable roller support, the roller intermittently contacting the flexible tube as the roller support is rotated causing a quantity of liquid to be peristaltically moved within the tube. The pump arm may have a concave surface to accommodate the flexible tube and the convex surface of the roller, if desired. The stop device may be adjustable so as to permit adjustment and change of the pivotal travel of the pump arm. The rotatable roller assembly may be caused to intermittently contact the flexible tube through the use of an electric clutch to which the roller assembly is rotatably responsive. The rotatable roller assembly causes the pump arm and flexible tube to pivot in a direction away from the stop device while the means for applying a force causes the pump arm and flexible tube to pivot in a direction towards the stop device.

U.S. Pat. No. 4,722,372 to Hoffman, et al. discloses electrical batteries integrated with a disposable container of flowable material for powering a dispensing apparatus. The disposable container includes a deform able chamber for containing a predetermined quantity of material to be dispensed, and an electrically energized actuating member deforms the chamber for dispensing the flowable material. The dispensing apparatus is actuated by a photocell system which electrically energizes the actuating member in response to the proximity of a user to the dispensing apparatus without the user contacting the apparatus. The photocell system normally is inactive, and is rendered active by a sensor for detecting the proximity of a user to the apparatus.

U.S. Pat. No. 4,967,940 to Blette et al. discloses a method and apparatus for precision control of work fluids in a squeezable tube that has no surge of work material during the shut off closing of the tube which is accomplished by a compensator moving simultaneously and oppositely to the shut off member movement, each of the compensator and the shut off member having different stroke lengths and tube engagable surface areas which effectively keep the internal volume of the tube the same. The method and apparatus are useful standing alone, in coordination with precision positive displacement pumping under computer control which is also presented, and as a part of sequential or simultaneous movement of a valve/pump dispensing head coordinated with a stationary or movable work piece to provide exceedingly fine control dispensing. Suckback between dispensing shots is coordinated with shut off and movements of inlet, outlet and dispensing members to afford operator programmable dispensing with precision and without drip.

U.S. Pat. No. 5,217,355 to Hyman, et al. discloses a linear peristaltic pump for pumping fluid through a resilient tube has a pair of pumping fingers, a pair of pinching fingers, and a strain gauge to monitor pressure inside the tube. The first pumping finger squeezes the tube at a first location, and the second pumping finger squeezes the tube at a second location. Additionally, the first pumping finger is configured and operated to displace approximately twice the fluid volume displaced by the second pumping finger. The first pinching finger occludes the tube upstream to the first pumping finger and the second pinching finger occludes the tube between the first and second pumping fingers. To monitor dimensional changes in the outer diameter of the tube and thereby indicate pressure inside the tube, the strain gauge is mounted on the pump between the second pinching finger and first pumping fingers. Finally, a leaf spring and photoelectric sensor are associated with the first pumping finger to indicate when the finger is in its fully withdrawn position.

U.S. Pat. No. 5,252,044 to Raines, et al. discloses an ambulatory parenteral fluid infusion pump employing a disposable in-line cassette which provides three independent fluid paths between two flexible plastic sheets. The fluid path extends through a pump chamber having a piston plate secured to the flexible sheet at each pumping chamber. The sealed flexible sheets are housed in a rigid housing which provides an aperture through which a catch member formed on the piston plate extends, and having living hinges overlying the inlet and outlet paths for shutting off those paths. An outlet valve is normally closed, and operates in response to buildup of fluid pressure from advancement of the piston plate into the pump chamber to deliver fluid.

U.S. Pat. No. 5,255,822 to Mease, et al. discloses an automatically operated soap dispenser for use in washing the hands of a user is provided in a housing. Enclosed in an intermediate portion of the housing is a horizontally disposed transparent cylindrical chamber having an open front end and an opening in the upper wall thereof. Residing in the upper portion of the housing is a disposable liquid soap container having extending from the bottom thereof a resilient elongated tubular member with a self-sealing nipple valve on the lower end thereof which is positioned in the opening on the upper wall of the cylindrical chamber. A cyclically operated actuating means located in the housing above the cylindrical chamber is controlled to automatically squeeze the tubular member and supply a single quantity of liquid soap through the nipple valve in response to an upturned palm of a hand of the user being inserted into the open front of the cylindrical chamber.

U.S. Pat. No. 5,316,452 to Bogen, et al. discloses a cartridge pump and dispensing assembly for applications where cartridges containing liquid reagents are interchanged often. The cartridge pump comprises a reagent reservoir which directly empties into a metering chamber. A valve is at each end of the metering chamber. The two valves are aligned in the same direction so as to allow unidirectional liquid flow. The metering chamber is made of a compressible material, such as flexible tubing, so that when an external compression is applied to the chamber, the liquid contained therein is forcibly expelled. As the compression is removed, the metering chamber resumes its former shape and draws liquid into the chamber from the reagent reservoir. A dispensing assembly with electromechanical actuators for compression of the metering chamber and a means for sensing the amount of liquid contained within the reagent reservoir are also shown.

U.S. Pat. No. 5,402,913 to Graf discloses a dispenser of a flowable medium, especially a lubricant, with a flexible wall tube forming the pumping chamber which is connected to a container for the flowable medium by a check-valve and feeds a dispensing nozzle. The pumping chamber is deformed by a plunger actuated by a lever in turn displaced by a solenoid whose linearly displaceable rod bears upon the lever.

U.S. Pat. No. 5,593,290 to Greisch, et al. discloses a multiple-chamber pump for dispensing precise volumes of fluids. The pump is especially suited for dispensing volumes in the microliter range. At least three chambers comprising preferably spherical segments are sequentially connected by conduits and are closed by a diaphragm member which is movable into or out of the chambers by application of pressure or vacuum on one side of the diaphragm to draw liquid into the chambers and then to expel the liquid from the chambers, either forward or backward according to an operating sequence. Control means are provided for alternating and sequencing the application of pressure and vacuum such that metered volumes of liquid are pumped from chamber to chamber. Tiny, precisely controlled drops of liquid can be dispensed. A plurality of ganged pumps also can be provided in a single pump body to meter independently a plurality of fluids simultaneously. Advantageously, flows can be joined or split between ganged pumps to provide precise combinations of different fluids. Flows in any of the preferred pump configurations can be dispensed to one or a plurality of dispensing destinations.

U.S. Pat. No. 5,964,583 to Danby discloses a liquid delivery device which controls the flow of liquid from a liquid reservoir having a resilient tubing having a wall with a substantially cylindrical cross-section defining a flow lumen. The flow lumen is in fluid communication with the reservoir. A compression member selectively compresses a lengthwise segment of the cylindrical wall to collapse the flow lumen and releases the lengthwise segment to open the flow lumen. An elastomeric sleeve encloses greater than half an outer diameter of the cylindrical cross-section of the resilient tubing along at least a portion of the lengthwise segment of the cylindrical wall. The elastomeric sleeve biases the lengthwise segment of the resilient tube to restore it to its substantially cylindrical cross-section when the compression member releases the lengthwise segment.

U.S. Pat. No. 6,213,739 to Phallen, et al. discloses a liquid pumping apparatus for pumping liquids, more specifically a linear peristaltic pump apparatus. The apparatus includes a high durometer compressible elastomeric liquid flow tube an infeed valve assembly and an outfeed valve assembly. An extensible and retractable actuator anvil have a round surface which engages the flow tube at all times. An opposed anvil having a round surface engages with the flow tube at all times. The flow tube is held between the anvils in a slightly compressed state when the anvil is retracted. A control assembly causes the movable anvil to be sequentially extended and retracted to cause flow within the flow tube from the infeed valve assembly to the outfeed valve assembly. With this apparatus the lumen of the flow tube to the sides of the anvils is not completely reduced to zero volume during displacement compression whereby gas embolisms do not erupt or explode when discharged.

Although the prior art United States patents have progressed the metering pump art, there is still a need in the art for a very accurate, low cost and reliable metering pump suitable for metering liquid concentrates of a highly concentrated nature.

Therefore, it is an object of the present invention to provide an improved pump for metering a liquid that is capable of accurately metering and discharging a liquid from a container.

Another object of this invention is to provide an improved pump for metering a liquid utilizing a multiple action metering pump for accurately metering and discharging a liquid.

Another object of this invention is to provide an improved pump for metering a liquid that is capable of being programmed for metering and discharging different metered volumes of liquid.

Another object of this invention is to provide an improved pump for metering a liquid that is suitable for metering and discharging a liquid concentrate for mixing with a diluent.

Another object of this invention is to provide an improved pump for metering a liquid that is suitable for metering a liquid concentrate food product containing small quantities of undissolved particles or particulates.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to a pump for metering a liquid from a container comprising a flexible tube extending between a first and a second tube end with the first tube end connected to the container. A pressure relief valve is located in the flexible tube. A pump housing has an pump housing aperture for receiving the flexible tube. A compression surface is located adjacent to the pump housing aperture. A reciprocating member has a pumping element and sealing element extending beyond the pumping element. A drive moves the sealing element for pinching the flexible tube against the compression surface upstream from the pressure relief valve for trapping liquid between the sealing element and the pressure relief valve. The drive moves the pumping element for collapsing the flexible tube against the compression surface for pumping the trapped liquid to discharge a metered quantity of the liquid from the pressure relief valve.

Preferably, the pressure relief valve comprises a valve element located in proximity to the second tube end of the flexible tube. The valve element comprises a deformable biasing element integrally attached to the valve element for biasing the valve element into a closed position.

In one embodiment of the invention, the valve element comprises a longitudinally deformable biasing element integrally attached to the valve element for biasing the valve element into a closed position. In another embodiment of the invention, the pressure relief valve includes a deformed annular shaped valve element biased in a closed position. The annular shaped valve element is deformable radially outwardly for opening the pressure relief valve. In still another embodiment of the invention, the pressure relief valve includes a ball valve element and a biasing spring for biasing the ball valve element into a closed position.

In another embodiment of the invention, the invention is incorporated into a support for mounting a collapsible container bag containing a liquid and a metering pump within a cabinet. The collapsible container bag has a flexible tube for discharging the liquid. The cabinet has a cabinet aperture located in a bottom wall of the cabinet. The support comprises a base plate having a base plate aperture with a base plate magnetic material located in proximity thereto. The base plate is secured to the bottom wall of the cabinet with the base plate aperture being aligned with the cabinet aperture. A base plate aligner is defined by the base plate. A saddle comprising plural supports has a saddle aperture located between the plural supports. The saddle has a saddle aligner for cooperating with the base plate aligner for aligning the saddle aperture with the base plate aperture. A magnet is located on the saddle in proximity to the saddle aperture magnetically coupling with the base plate magnetic material for maintaining the position of the saddle relative to the base plate. A collapsible container bag contains a liquid. A flexible tube extends from the collapsible container bag for discharging the liquid from the collapsible container bag. The flexible tube is insertable through the saddle aperture and the base plate aperture to extend from the cabinet aperture with the plural supports of the saddle supporting the collapsible container bag. A flexible tube magnetic material is magnetically coupled with the magnet located on the saddle for maintaining the position of the flexible tube and the collapsible container bag relative to the saddle.

In still another embodiment of the invention, the invention is incorporated into a pump drive for driving a metering pump including a flexible tube having a pressure relief valve connected to a source of a liquid. The pump drive comprises an electric motor has a rotary drive defining a rotary drive axis. A drive roller is secured to the rotary drive and located offset from the rotary drive axis. A yoke has a generally rectangular yoke aperture for cooperating with the drive roller for providing a reciprocating motion to the yoke upon a rotary motion of the electric motor. A pump housing has a pump housing aperture for receiving the flexible tube. A cylindrical bore extends perpendicular to the pump housing aperture. A reciprocating member comprises a piston slidably disposed within the cylindrical bore. The yoke is connected to the piston for reciprocating the piston within the cylindrical bore upon a rotary motion of the electric motor. The piston has a piston end wall for defining a pumping element. A sealing element is resiliently mounted to the piston to extend beyond the piston end wall of the piston. The electric motor moves the sealing element of the piston for pinching the flexible tube for trapping liquid between the sealing element and the pressure relief valve. The electric motor moves the pumping element of the piston for collapsing the flexible tube for pumping the trapped liquid to discharge a metered quantity of the liquid from the pressure relief valve.

In a further embodiment of the invention, the invention is incorporated into a control for a pump drive for driving a metering pump including a flexible tube having a pressure relief valve connected to a source of a liquid. The control comprises a pump housing having a pump housing aperture for receiving the flexible tube. A compression surface is located adjacent to the pump housing aperture. A reciprocating member has a pumping element and sealing element extending beyond the pumping element. An electric motor moves the sealing element of the reciprocating member for pinching the flexible tube for trapping liquid between the sealing element and the pressure relief valve. The electric motor moves the pumping element of the reciprocating member for collapsing the flexible tube for pumping the trapped liquid to discharge a metered quantity of the liquid from the pressure relief valve. An electronic control is connected to the electric motor for moving the reciprocating member a selected number of times for metering a desired quantity of the liquid.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
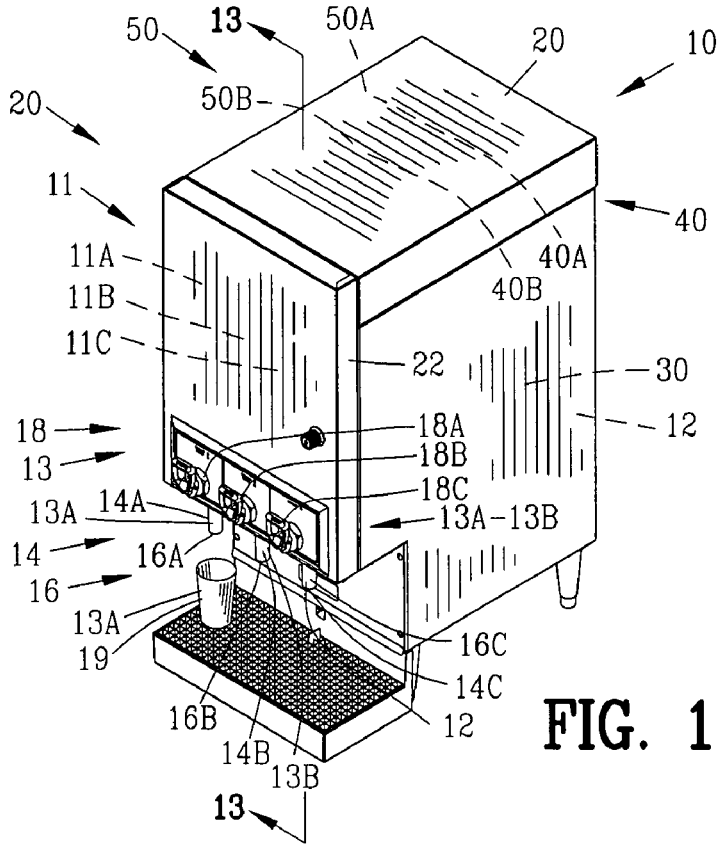
FIG. 1 is an isometric view of a dispenser system for dispensing a product formed from a liquid concentrate and a liquid diluent incorporating the present invention.

FIG. 1 is an isometric view of a dispenser device 10 for pumping a first liquid 11 and a second liquid 12. The first and second liquids 11 and 12 are formed into a mixed product 13 by a mixing device 14. The mixed product 13 is discharged by the mixing device 14 through a discharge aperture 16 into a vessel shown as a cup 19. In this example, the first liquid 11 is a liquid concentrate 11 such as a beverage concentrate whereas the second liquid 12 is a liquid diluent 12 such as potable water. An operator switch 18 controls the dispensing of the mixed product 13 into the cup 19. A cabinet 20 encloses the dispenser device 10.

The dispenser device 10 includes a second liquid diluent supply 30 for supplying a second liquid diluent 12 to the mixing device 14. The first liquid concentrate 11 is stored in a concentrate container 40. A metering pump 50 pumps the first liquid concentrate 11 from the concentrate container 40 into the mixing device 14. The operator switch 18 controls the second liquid diluent supply 30 and the metering pump 50.

Upon actuation of the operator switch 18, the second liquid diluent supply 30 provides the second liquid diluent 12 into the mixing device 14 while the metering pump 50 provides the first liquid concentrate 11 for mixing within into the mixing device 14. The mixed first liquid concentrate 11 and the second liquid diluent 12 are discharged as the mixed product 13 from the discharge aperture 16.

In this specific example, the dispenser device 10 includes two concentrate containers 40A and 40B for storing two separate first liquid concentrates 11A and 11B. The dispenser 10 includes two separate metering pumps 50A and 50B and two separate mixing devices 14A and 14B controlled by two separate switches 18A and 18B. The metering pump 50A and 50B pump the two separate first liquid concentrates 11A and 11B to mix with the common second liquid diluent 12 to provide two separate mixed products 13A and 13B. The two separate mixed products 13A and 13B are discharged from two separate discharge apertures 16A and 16B. In this specific example, the dispenser device 10 includes a third switch 18C to discharge the common second liquid diluent 12 to separate discharge aperture 16C.

Figure 2:
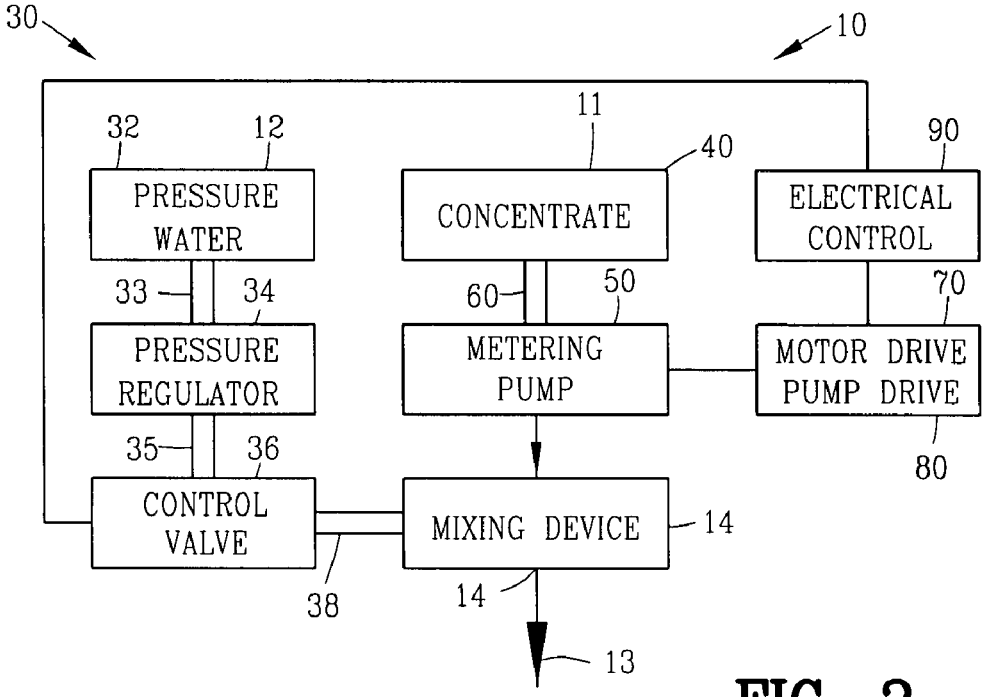
FIG. 2 is a block diagram of the dispenser system of FIG. 1.
Figure 3:
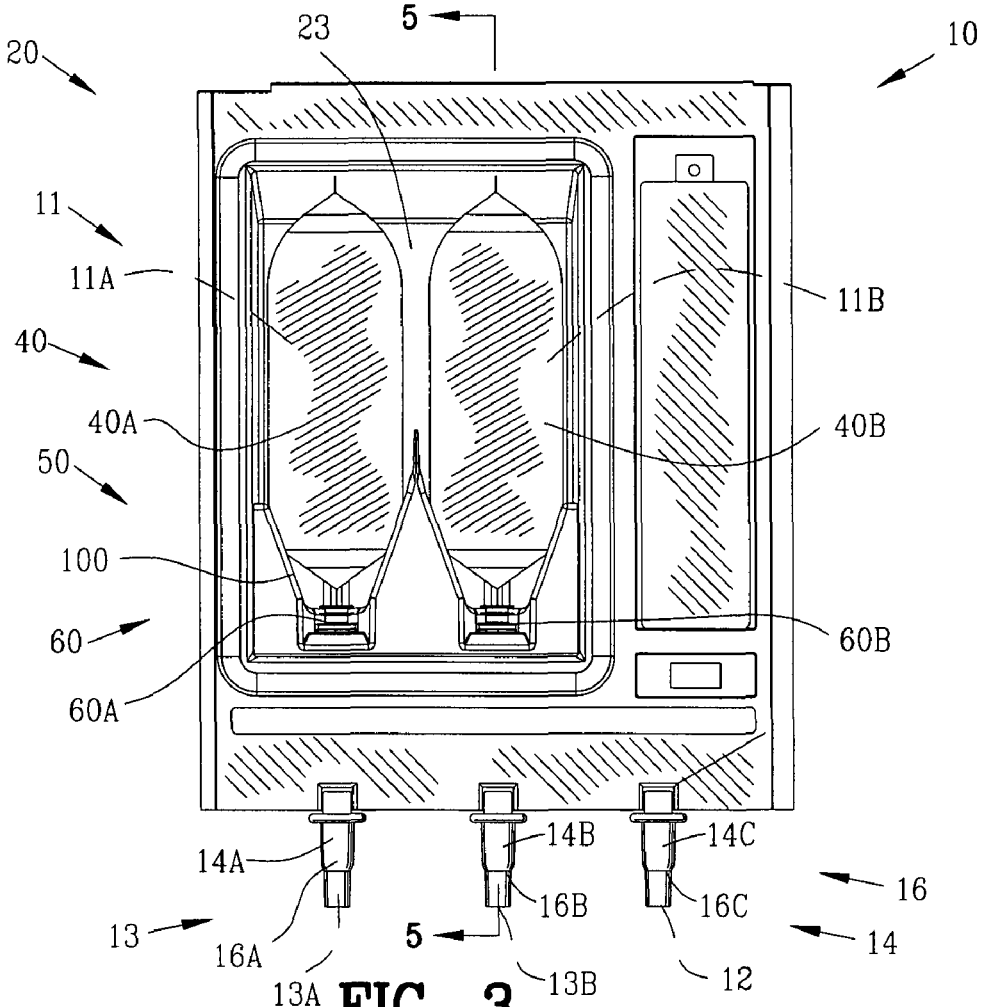
FIG. 3 is a front view of the dispenser system of FIG. 1 with a front panel removed.
Figure 4:
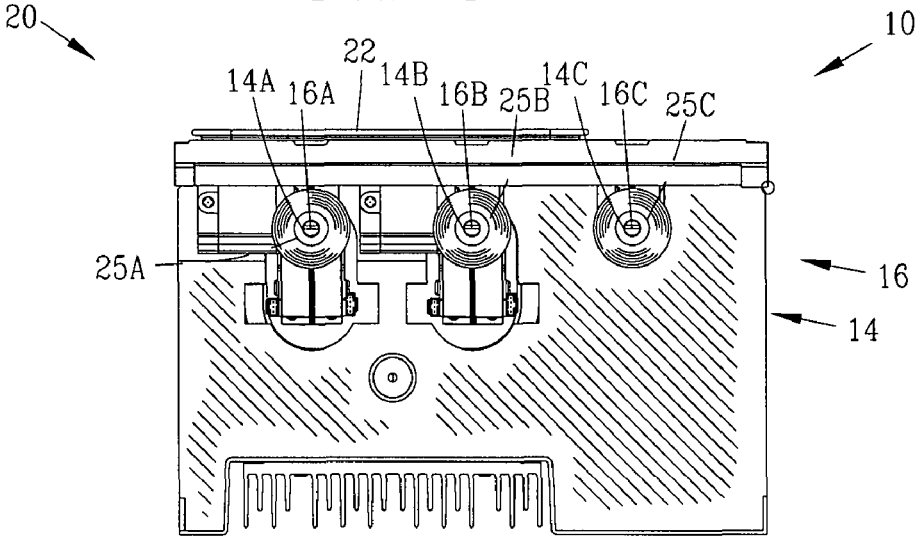
FIG. 4 is a bottom view of FIG. 3.
Figure 5:
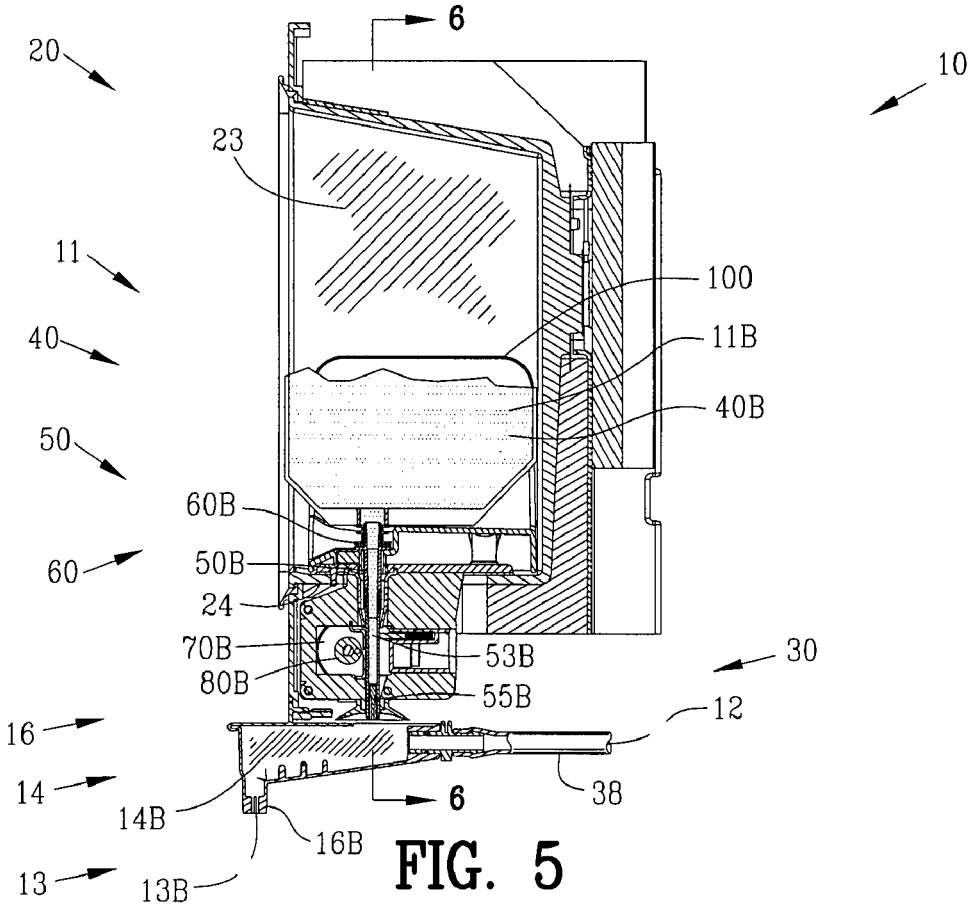
FIG. 5 is a sectional view along line 5-5 in FIG. 3.

FIG. 2 is a block diagram illustrating a portion of the dispenser device 10 dispensing the mixed products 13A of FIG. 1. The portion of the dispenser device 10 dispensing the mixed products 13B of FIG. 1 is identical to the block diagram of FIG. 2.

The second liquid diluent supply 30 comprises a pressurized source 32 of the second liquid diluent 12 connected through a conduit 33 to a fluid regulator 34. The second liquid diluent 12 is supplied under regulated pressure by a conduit 35 to a control valve 36 and conduit 38 to the mixing device 14.

The concentrate container 40 communicates with the metering pump 50 through a coupling 60 for enabling the metering pump 50 to pump the first liquid concentrate 11 into the mixing device 14. A pump motor 70 and a pump drive 80 drive the metering pump 50.

An electrical control 90 is connected to operate the control valve 36 and the pump motor 70. Upon actuation of the switch 18, the second liquid diluent 12 flows through the water valve 36 and conduit 38 into the mixing device 14. Simultaneously, the metering pump 50 pumps the first liquid concentrate 11 from the concentrate container 40 into the mixing device 14. The mixing device 14 mixes the first liquid concentrate 11 with the second liquid diluent 12 to discharge the mixed product 13 from the discharge aperture 16.

FIGS. 3-8 illustrate various views the dispenser device 10 of FIG. 1. The two identical portions of the dispenser device 10 dispensing the mixed products 13A and 13B of FIG. 1 is identical to the block diagram of FIG. 2. The cabinet 20 comprises a front access door 22 for enabling an operator to access an interior region 23 of the cabinet 20. Preferably, the dispenser device 10 includes a refrigeration unit (not shown) for refrigerating the interior region 23 of the cabinet 20.

The cabinet 20 has a bottom wall 24 having cabinet apertures 25A and 25B. A saddle 100 is removably mounted within the interior region 23 of the cabinet 20 for supporting the concentrate containers 40A and 40B. The saddle 100 is provided with saddle apertures 102A and 102B aligned with the cabinet apertures 25A and 25B in the bottom wall 24 of the cabinet 20.

The concentrate container 40A is shown as a flexible bag for eliminating the need for a venting system. However, it should be appreciated by those skilled in the art that a vented rigid concentrate container (not shown) may be used with the present invention.

The metering pump 50A is shown extending between a first and a second end 51A and 52A and defining an internal duct 53A therethrough. The first end 51A is connected to the concentrate container 40A by the coupling 60A. The coupling 60A may permanently connect the first end 51A to the concentrate container 40A to prevent the unauthorized removal of the first end 51A from the concentrate container 40A. The permanent connection of the first end 51A to the concentrate container 40A inhibits the refilling of the concentrate container 40A with an inferior or an unauthorized liquid concentrate.

A pressure relief valve 55A is located in proximity to the second end 52A of the metering pump 50A. Under nominal pressure conditions, the pressure relief valve 55A prevents the first liquid concentrate 11A of the concentrate container 40A from being discharged from the second end 52A of the metering pump 50A. In this example, the metering pump 50A is shown as a metering pump flexible tube 56A having a substantially circular cross-section extending between the first and second ends 51A and 52A. Preferably, the metering pump flexible tube 56A is a transparent or translucent tube for enabling the first liquid concentrate 11A to be viewed within the metering pump flexible tube 56A. The venting or collapsing of the concentrate container 40A enables the first liquid concentrate 11A of the concentrate container 40A to fill completely the internal duct 53A of the metering pump 50A.

Similarly, the metering pump 50B extends between a first and a second end 51B and 52B with an internal duct 53B therethrough. The first end 51B is connected to the concentrate container 40B by the coupling 60B. A pressure relief valve 55B is located in proximity to the second end 52B of the metering pump 50B.

The pump motors 70A and 70B and the pump drives 80A and 80B are mounted below the bottom wall 24 of the cabinet 20. The pump drives 80A and 80B include pump drive apertures 82A and 82B aligned with the cabinet apertures 25A and 25B.

An operator loads the concentrate containers 40A and 40B and the attached metering pumps 50A and 50B into the interior region 23 of the cabinet 20 to be supported by the saddle 100 and with the second ends 52A and 52B of the metering pump 50A and 50B extending through the cabinet apertures 25A and 25B and into the pump drive apertures 82A and 82B.

Upon actuation of the respective operator switches 18A and 18B, the respective pump motor 70A and 70B and the pump drive 80A and 80B operates the respective metering pump 50A and 50B for pumping the respective first liquid concentrate 11A and 11B into the respective mixing devices 14A and 14B. Simultaneously, the second liquid diluent supply 30 provides the second liquid diluent 12 into the respective mixing devices 14A and 14B for mixing with the respective first liquid concentrate 11A and 11B within the mixing device 14 to exit from the respective discharge aperture 16A and 16B.

Upon depletion of the respective liquid concentrates 11A and 11B from the concentrate containers 40A and 40B, an operator will remove the depleted one of the concentrate containers 40A and 40B and the attached metering pumps 50A and 50B from the interior region 23 of the cabinet 20. Preferably, the concentrate container 40 and the attached metering pump 50 is disposable.

An operator loads a new filled concentrate container 40 and an attached metering pump 50 into the interior region 23 of the cabinet 20 as heretofore described. The present invention ensures that a new metering pump 50 is provided for each new concentrate container 40 loaded into the dispenser device 10.

Figure 7:
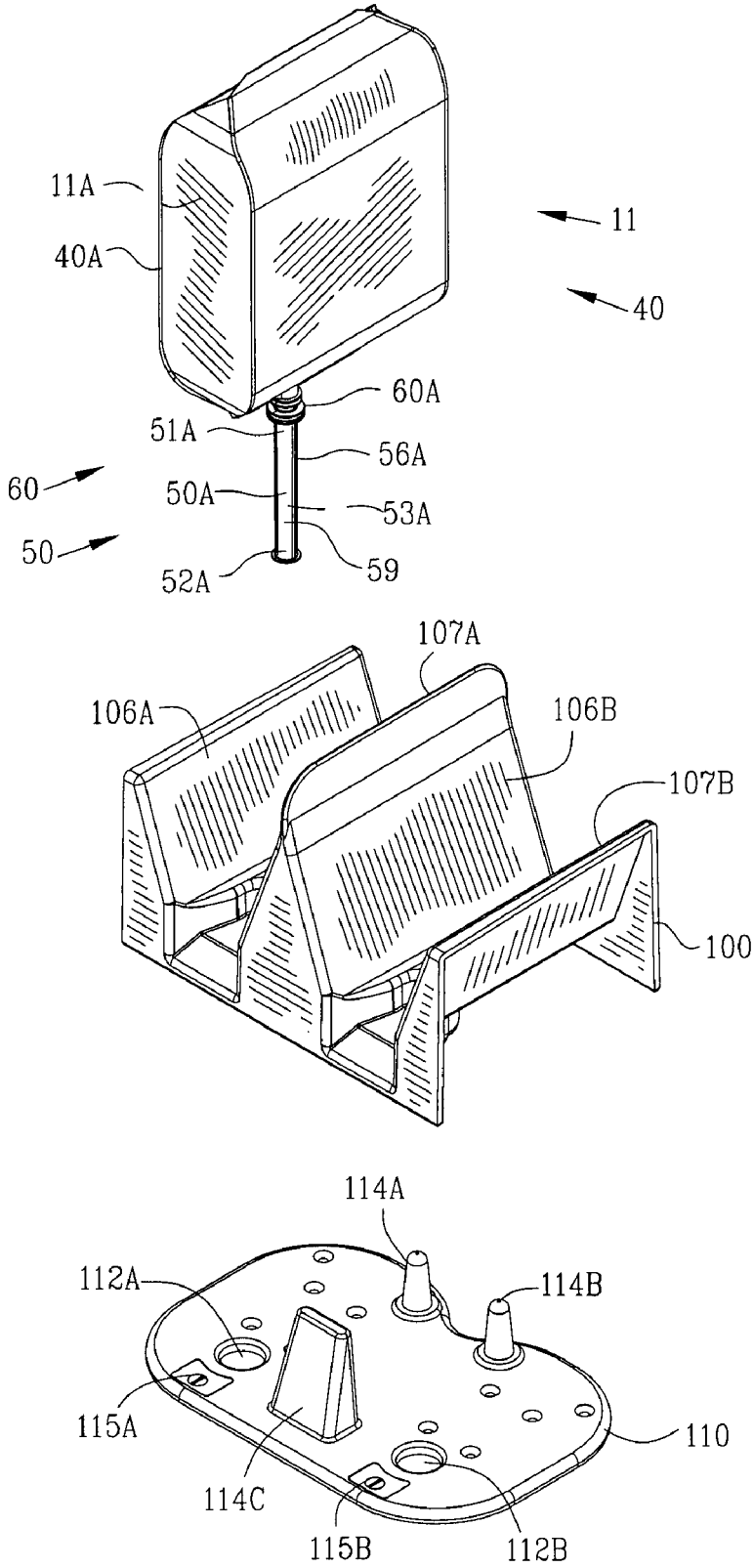
FIG. 7 is an enlarged top exploded view of a base plate for mounting a saddle to support a concentrate container and the metering pump of the present invention.
Figure 8:
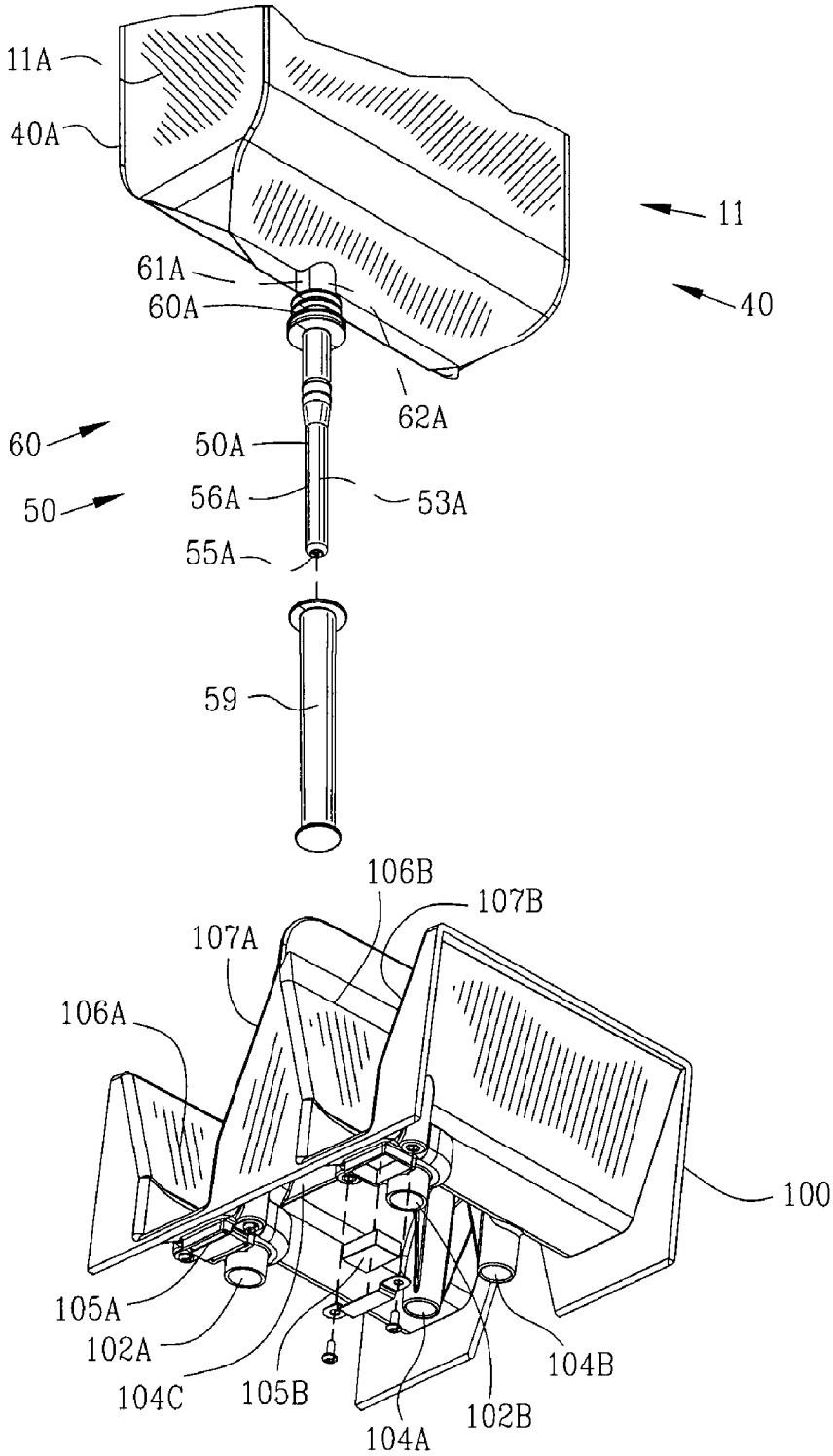
FIG. 8 is an enlarged bottom exploded view of the saddle, the concentrate container and the metering pump of FIG. 7.

FIGS. 7 and 8 are top and bottom exploded views of a saddle 100 cooperating with a base plate 110 for mounting a saddle 100 to the bottom wall 24 of the cabinet 20. The saddle 100 includes saddle aligners 104A-104C for aligning the saddle 100 to the base plate 110. The saddle 100 includes saddle magnets 105A and 105B for securing the aligned saddle 100 to the base plate 110. The saddle magnets 105A and 105B are located in proximity to the saddle aperture 102A and 102B.

The base plate 110 is mounted to the bottom wall 24 of the cabinet 20 by conventional means such as mechanical fasteners and the like. The base plate 110 includes base plate apertures 112A and 112B aligned with the aligned with the cabinet aperture 25A and 25B of the cabinet 20. The base plate 110 includes base plate aligners 114A-114C for cooperating with saddle aligners 104A-104C for aligning the saddle 100 to the base plate 110.

The base plate 110 includes 115A base magnetic material 115A and 115B for cooperating with the saddle magnets 105A and 105B for magnetically securing the aligned saddle 100 to the base plate 110. When the saddle 100 is aligned to with the base plate 110, the saddle apertures 102A and 102B, the base plate aperture 112A and 112B are aligned with the cabinet apertures 25A and 25B and the pump drive apertures 82A and 82B.

The saddle 100 includes saddle surfaces 106A and 107A for supporting the concentrate container 40A and saddle surfaces 106B and 107B for supporting the concentrate container 40B. Preferably, the saddle surfaces 106A and 107A and the saddle surfaces 106B and 107B form a V-shape having an acute angle of forty degrees. The V-shape of the saddle surfaces 106A and 107A and the saddle surfaces 106B and 107B maintain the position of the concentrate containers 40A and 40B as the liquid concentrates 11A and 11B are depleted from the concentrate containers 40A and 40B.

The use of the base plate 110 for mounting the saddle 100 within the bottom wall 24 of the cabinet 20 as set forth above is very useful for adapting the present invention to existing dispenser devices of the prior art. However, it should be understood that the saddle 100 may be molded into a newly designed dispenser device thus eliminating the need for the base plate 110.

Figure 6:
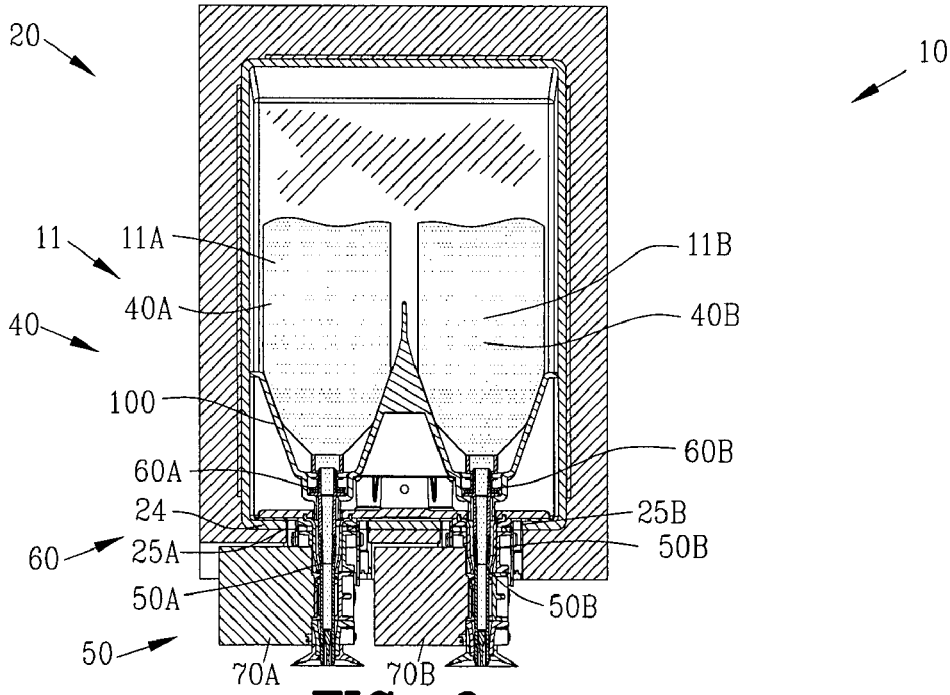
FIG. 6 is a sectional view along line 6-6 in FIG. 5.
Figure 9:
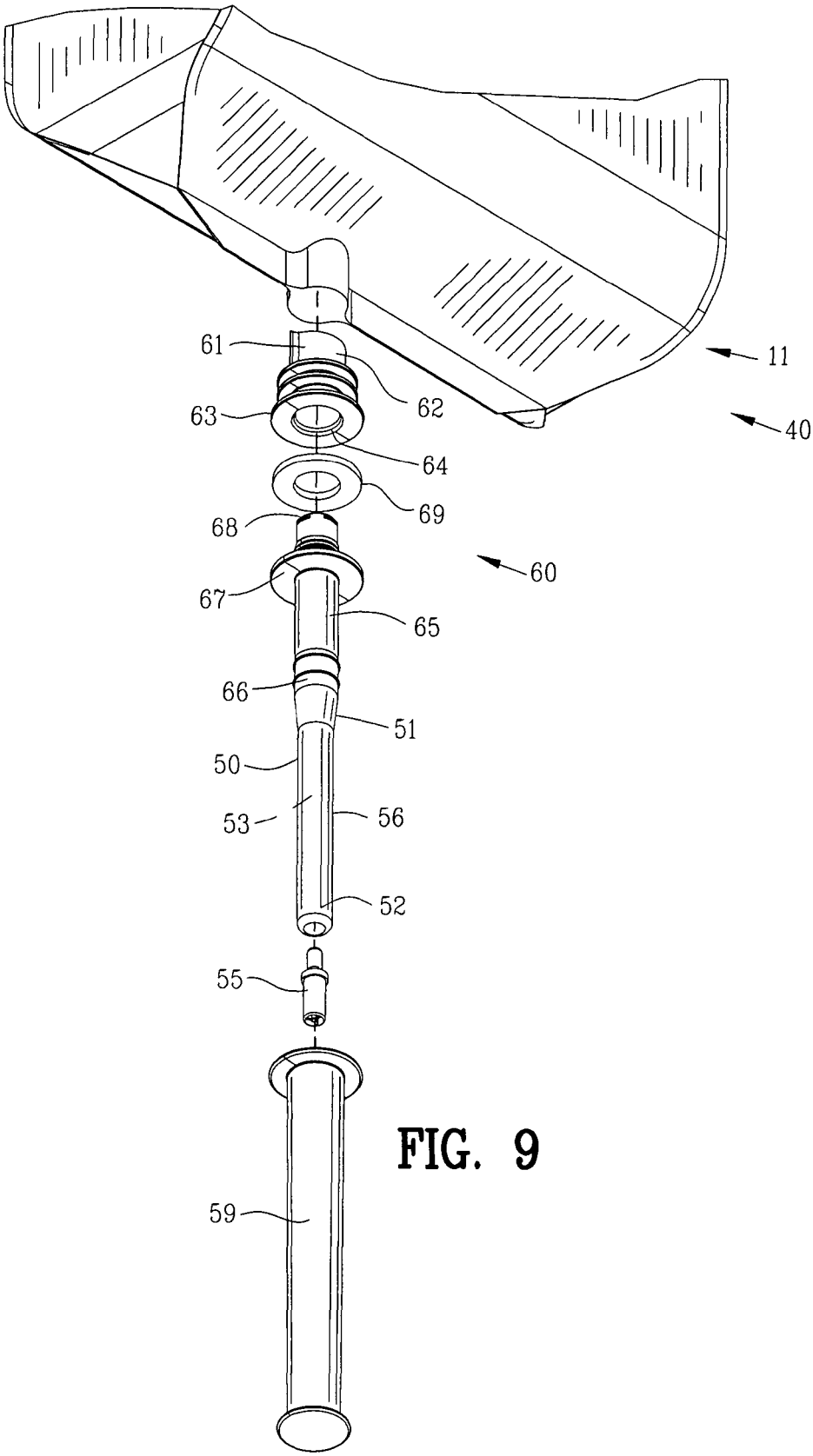
FIG. 9 is an enlarged bottom exploded view of the metering pump of FIG. 8.
Figure 10:
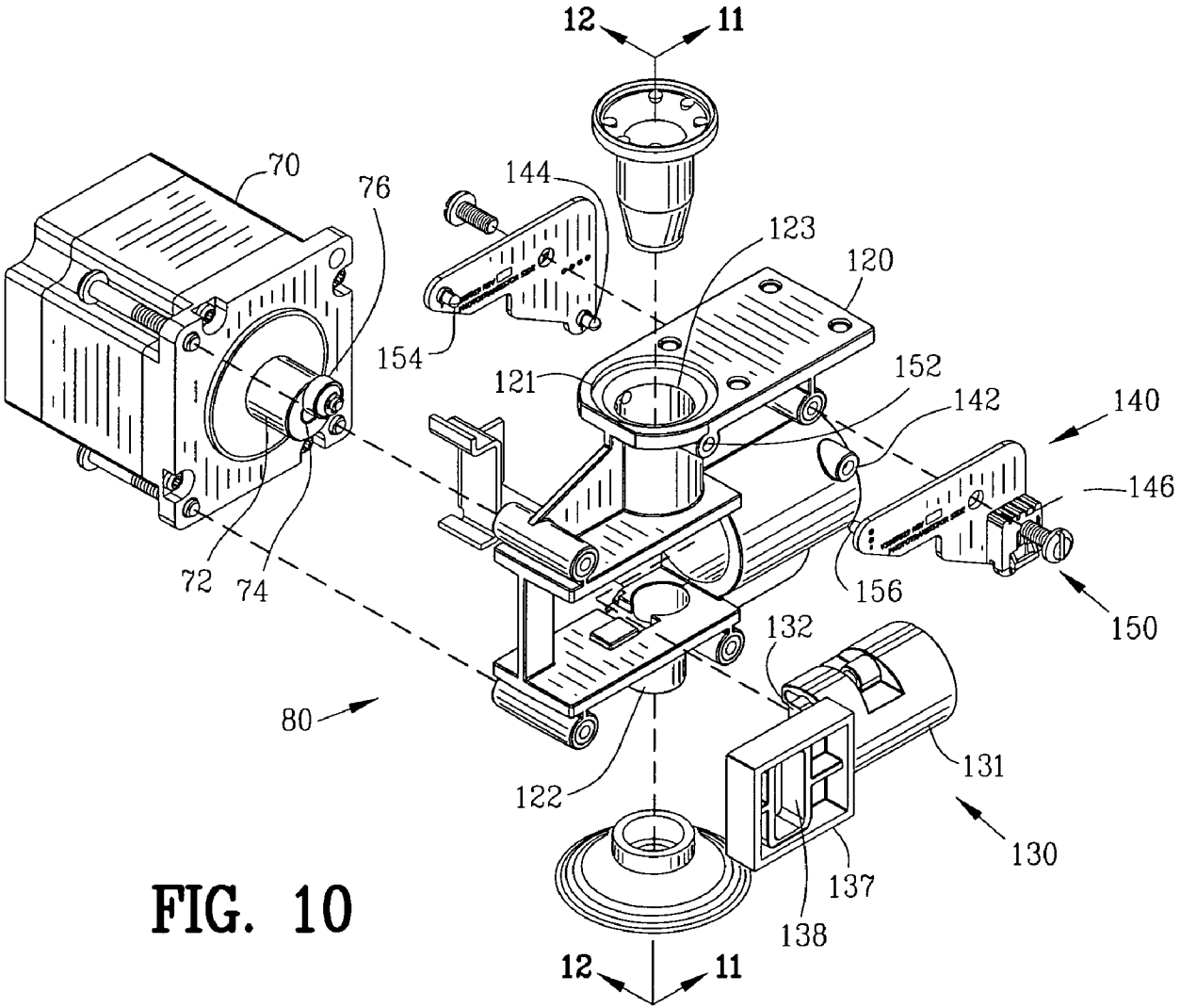
FIG. 10 is an enlarged exploded isometric view of a motor drive unit for powering the metering pump of FIGS. 7-9.
Figure 11:
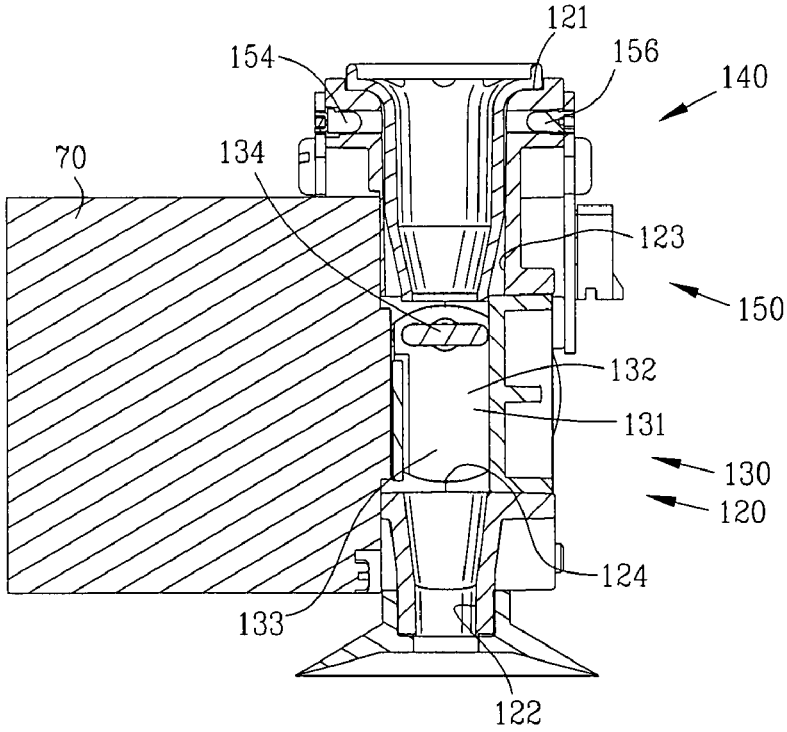
FIG. 11 is an enlarged sectional view along line 11-11 in FIG. 10.
Figure 12:
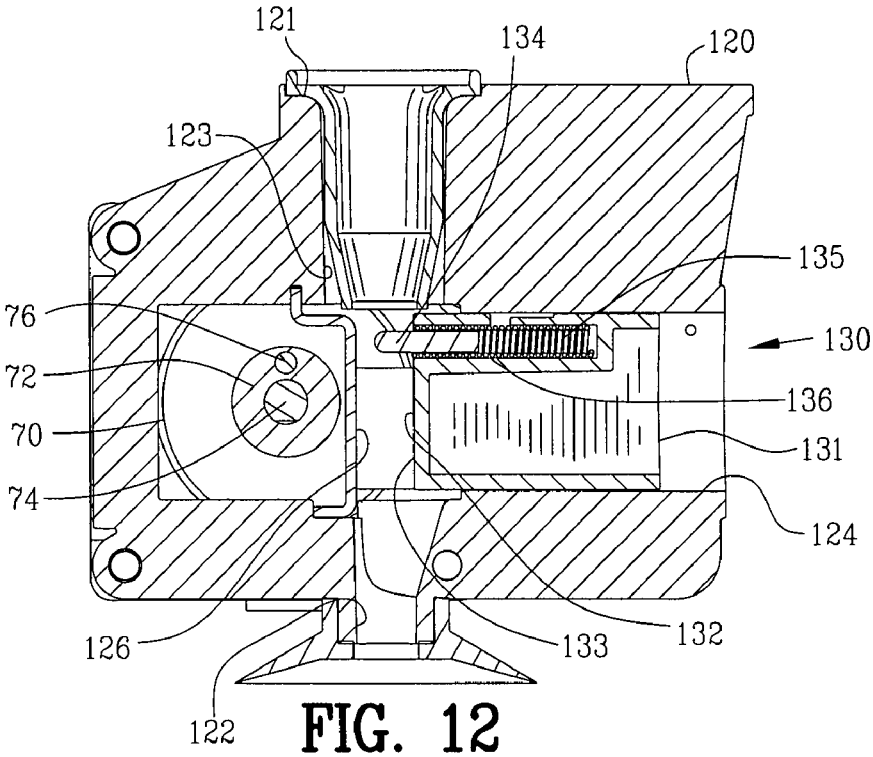
FIG. 12 is an enlarged sectional view along line 12-12 in FIG. 10.
Figure 13:
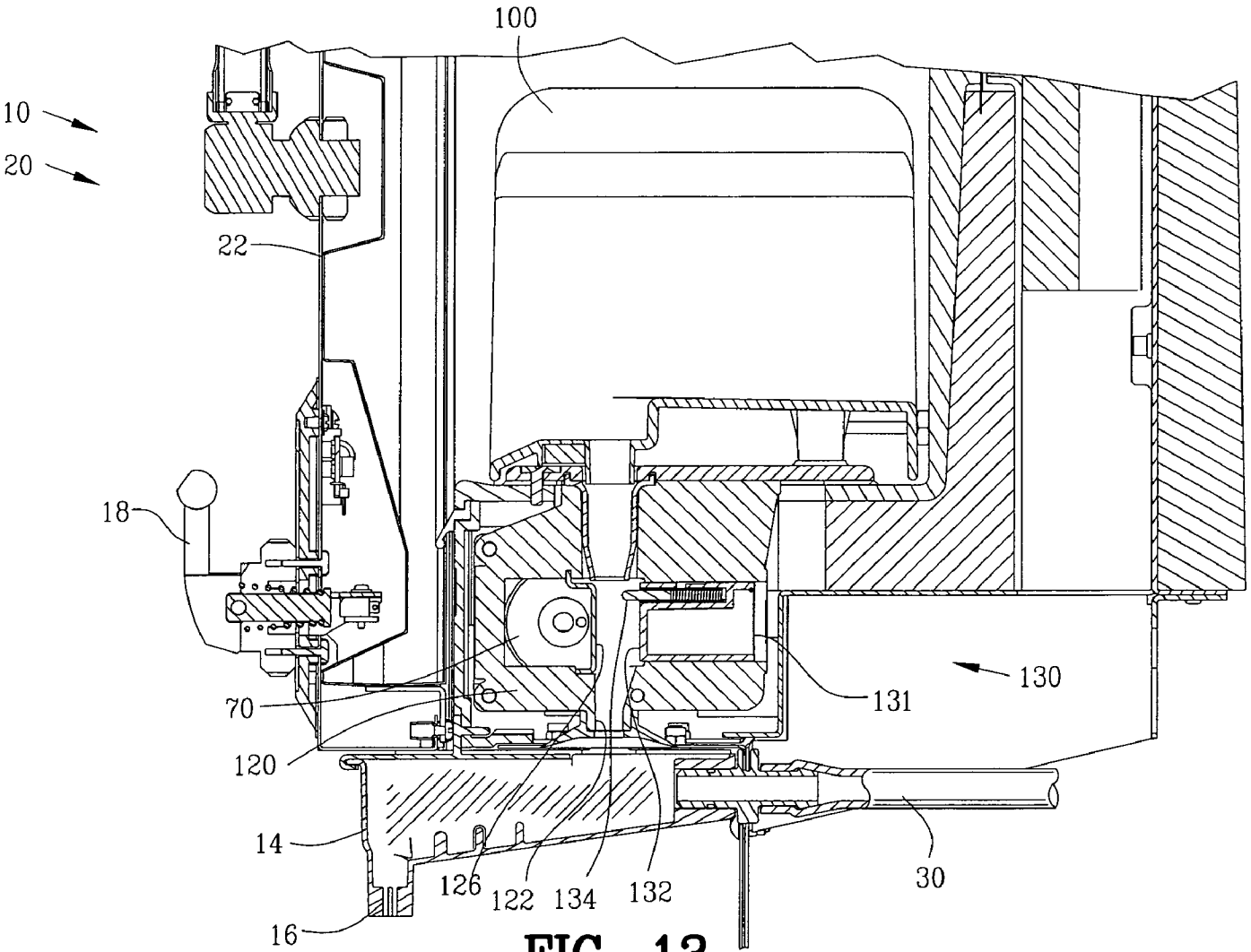
FIG. 13 is an enlarged partial sectional view along line 13-13 in FIG. 1 with the concentrate container and the metering pump removed from the motor drive unit.

FIG. 9 is an enlarged bottom exploded view of the concentrate container 40, the metering pump 50 and the coupling 60 shown in FIGS. 6-8. The coupling 60 comprises a container fitment 61 having an attachment portion 62 for securing to the concentrate container 40. The attachment portion 62 may be secured to the concentrate container 40 by suitable means. The container fitment 61 includes a container fitment flange 63 and a container fitment coupling 64.

The coupling 60 comprises a pump fitment 65 having an attachment portion 66 for securing to the metering pump 50. The attachment portion 66 provides a support for over molding the metering pump flexible tube 56 of the metering pump 50. The pump fitment 65 includes a pump fitment flange 67 and a pump fitment coupling 68. The container fitment coupling 64 cooperates with the pump fitment coupling 68 to secure the concentrate container 40 to the metering pump 50. The coupling magnetic material 69 is interposed between the container fitment flange 63 and the pump fitment flange 67. Preferably, the container fitment coupling 64 forms a permanent coupling with the pump fitment coupling 68 to prevent refilling of the concentrate container 40.

The metering pump 50 is shown as the metering pump flexible tube 56 extending between the first and the second end 51 and 52. The first end of the metering pump flexible tube 56 is secured to the attachment portion 66 of the pump fitment 65. The pressure relief valve 55 is located within the internal duct 53 at the second end 52 of the metering pump flexible tube 56.

When the concentrate containers 40 and the attached metering pump 50 are loaded into the interior region 23 of the cabinet 20, the saddle surface 106 and 107 support the concentrate containers 40 within the saddle 100. The coupling magnetic material 69 cooperates with the saddle magnet 105 to maintain the position of the concentrate container 40 and the metering pump flexible tube 56 relative to the saddle 100.

A metering pump cover 59 may be secured to the metering pump 50 for covering the second end of the metering pump flexible tube 56 during storage and transportation. The metering pump cover 59 may be provided to protect consumable products such as consumable beverages and the like.

FIGS. 10-13 are various enlarged exploded views of the pump motor 70 and the pump drive 80 for powering the metering pump 50. The pump motor 70 is shown as an electric motor 70 having a rotary drive 72 defining a rotary drive axis 74. A drive roller 76 is secured to the rotary drive 72 and located offset from the rotary drive axis 74.

The pump drive 80 comprises a pump housing 120 and a reciprocating member 130 cooperating with the pump motor 70 for powering the metering pump 50. The pump drive 80 may also include a position sensor 140 and a sold out sensor 150.

The pump housing 120 extending between a first and a second end 121 and 122. The pump housing 120 has a pump housing aperture 123 for receiving the second end 52 of the flexible tube 56 of the metering pump 50. The pump housing aperture 123 defines a first and a second end coincident with the first and second ends 121 and 122 of the housing 120.

The pump housing aperture 123 has a bore selected to receive the metering pump flexible tube 56 therein. The pump housing 120 includes a cylindrical bore 124 extending perpendicular to the pump housing aperture 123.

The first end 121 of the aperture 123 includes an enlarged taper for facilitating the insertion of the second end 52 of the metering pump flexible tube 56 within the aperture 123. The second end 52 of the metering pump flexible tube 56 is inserted within the pump housing aperture 123 with the pressure relief valve 55 being located below the cylindrical bore 124 of the pump housing 120.

A compression surface 126 is mounted to the pump housing 120 to be located at the termination of the cylindrical bore 124. Preferably, the compression surface 126 is a substantially planar surface. The compression surface 126 may be integral with the pump housing 120 or may be a distinct member secured relative to the pump housing 120.

A reciprocating member 130 comprises a piston 131 slidably disposed within the cylindrical bore 124. The piston 131 has a piston end wall 132 defining a pumping element 133. A sealing element 134 is resiliently mounted to the piston 131 to extend beyond the piston end wall 132 of the piston 131. Preferably, a spring 135 resiliently mounts the sealing element 134 within a void 136 defined by the piston 131.

A spring 135 resiliently mounts the sealing element 134 within a void 136 defined the piston end wall 132 of the piston 131. The sealing element 135 extends outwardly from the piston end wall 132 of the piston 131. The sealing element 135 is aligned with the compression surface 126 of the pump housing 120.

The piston 131 is connected to the pump drive 80 for moving the piston 131 between a retracted position and an extended position. In this example, the pump drive 80 is an eccentric drive shown as a scotch yoke 137. The scotch yoke 137 has a generally rectangular yoke aperture 138 for cooperating with the drive roller 76 to provide a reciprocating motion to the scotch yoke 137 between a retracted position and an extended position upon a rotary motion of the electric motor 70. Preferably, the scotch yoke 137 is integrally formed with the piston 131.

A position sensor 140 is located on the pump housing 120 for determining the position of the piston 131 within the cylindrical bore 124. The position sensor 140 comprises a position sensor aperture 142 extending through the pump housing 120 and disposed transverse to the cylindrical bore 124. A light emitting device 144 is located at one end of the position sensor aperture 142 for cooperating with a light sensing device 146 located at the other end of the position sensor aperture 142 for sensing when the piston 131 interrupts the position sensor aperture 142.

A sold out sensor 150 is located on the pump housing 120 for sensing an absence of the first liquid concentrate 11 within the metering pump 50. The sold out sensor 150 comprises a sold out sensor aperture 152 extending through the pump housing 120 and disposed transverse to the pump housing aperture 123. A light emitting device 154 is located at one end of the sold out sensor aperture 142 for cooperating with a light sensing device 156 located at the other end of the sold out sensor aperture 152 for sensing an absence of the first liquid concentrate 11 within the metering pump 50.

Figure 14:
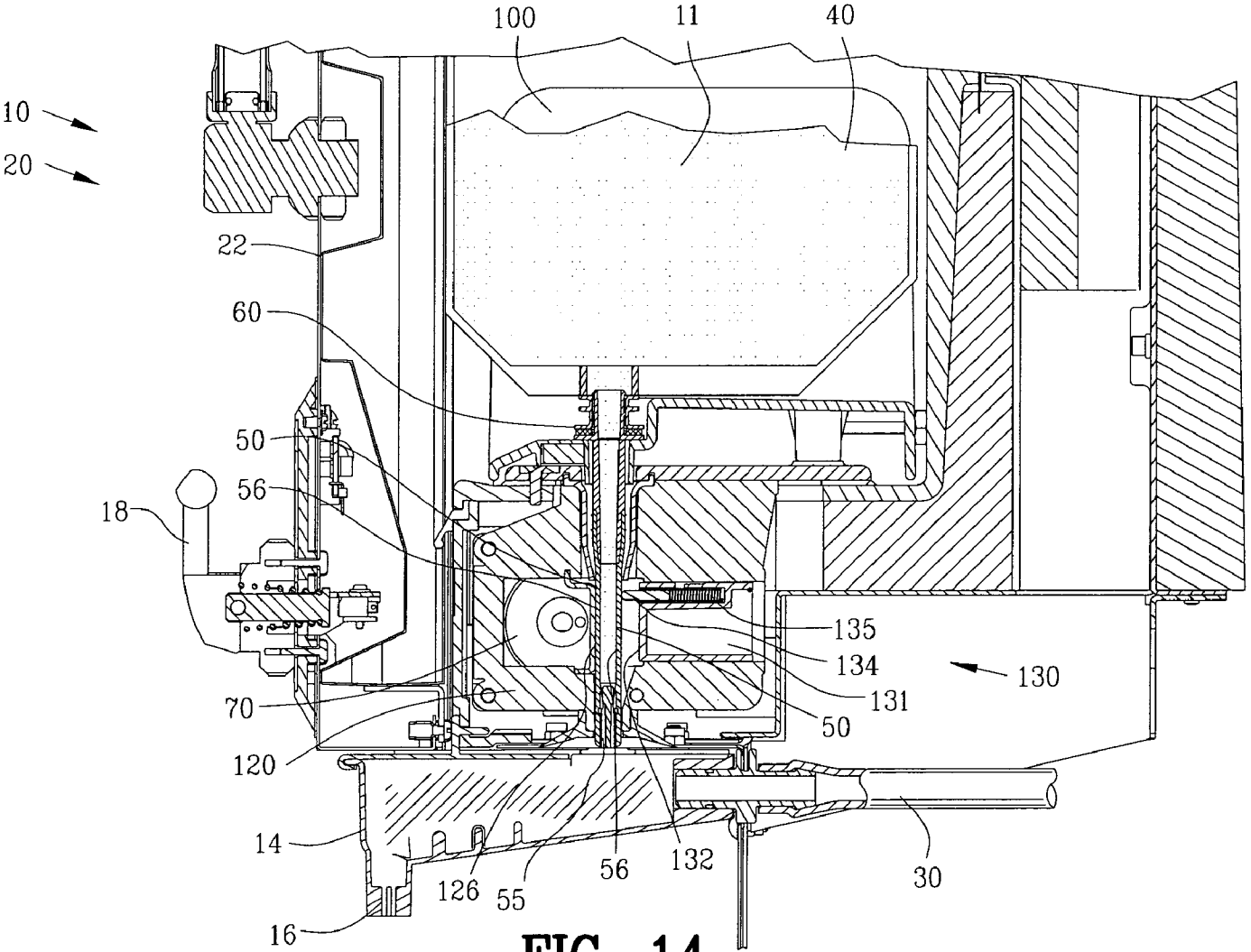
FIG. 14 is a view similar to FIG. 13 with the concentrate container and the metering pump inserted into the motor drive unit.
Figure 15:
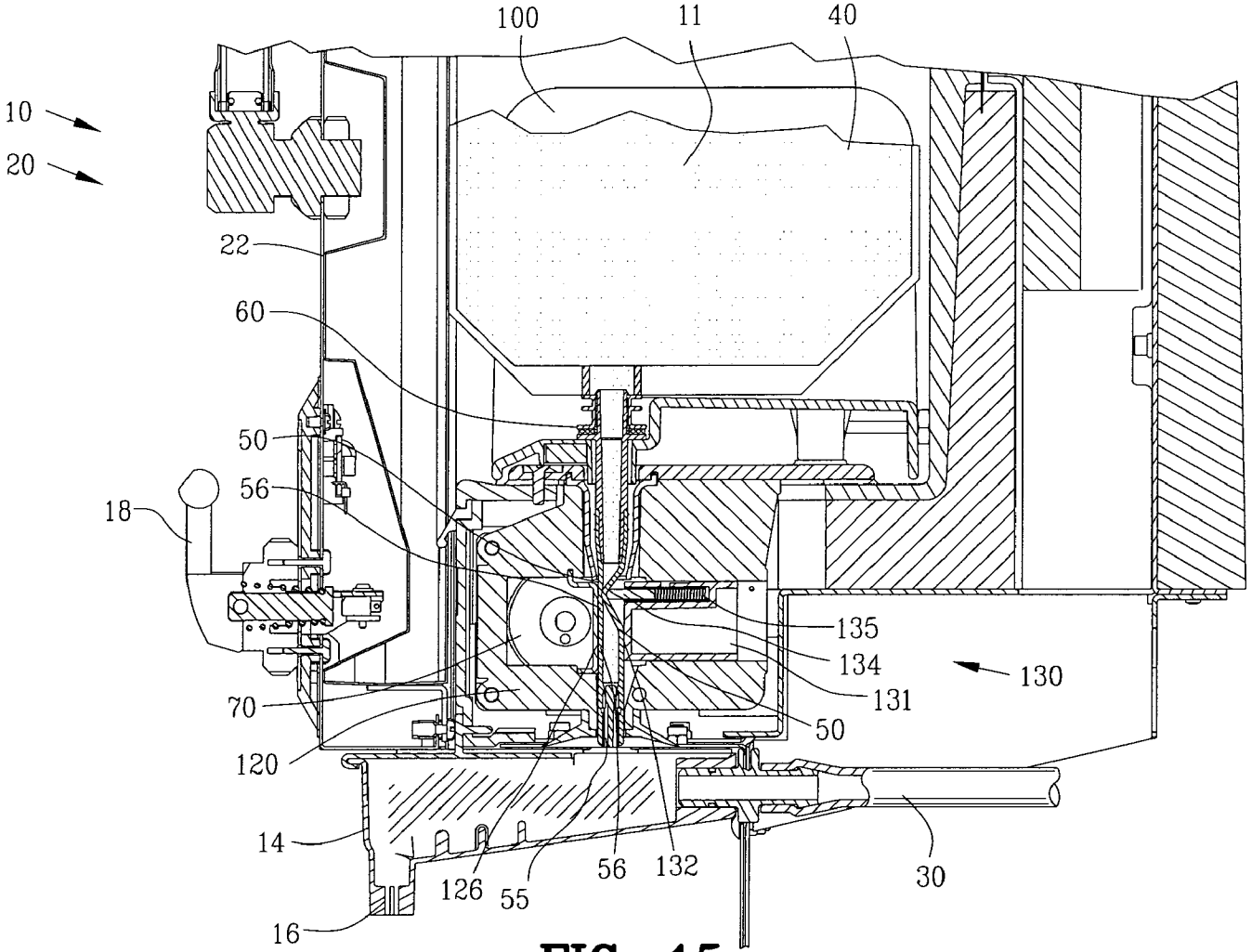
FIG. 15 is a view similar to FIG. 14 with a sealing element pinching a flexible tube against a compression surface.
Figure 16:
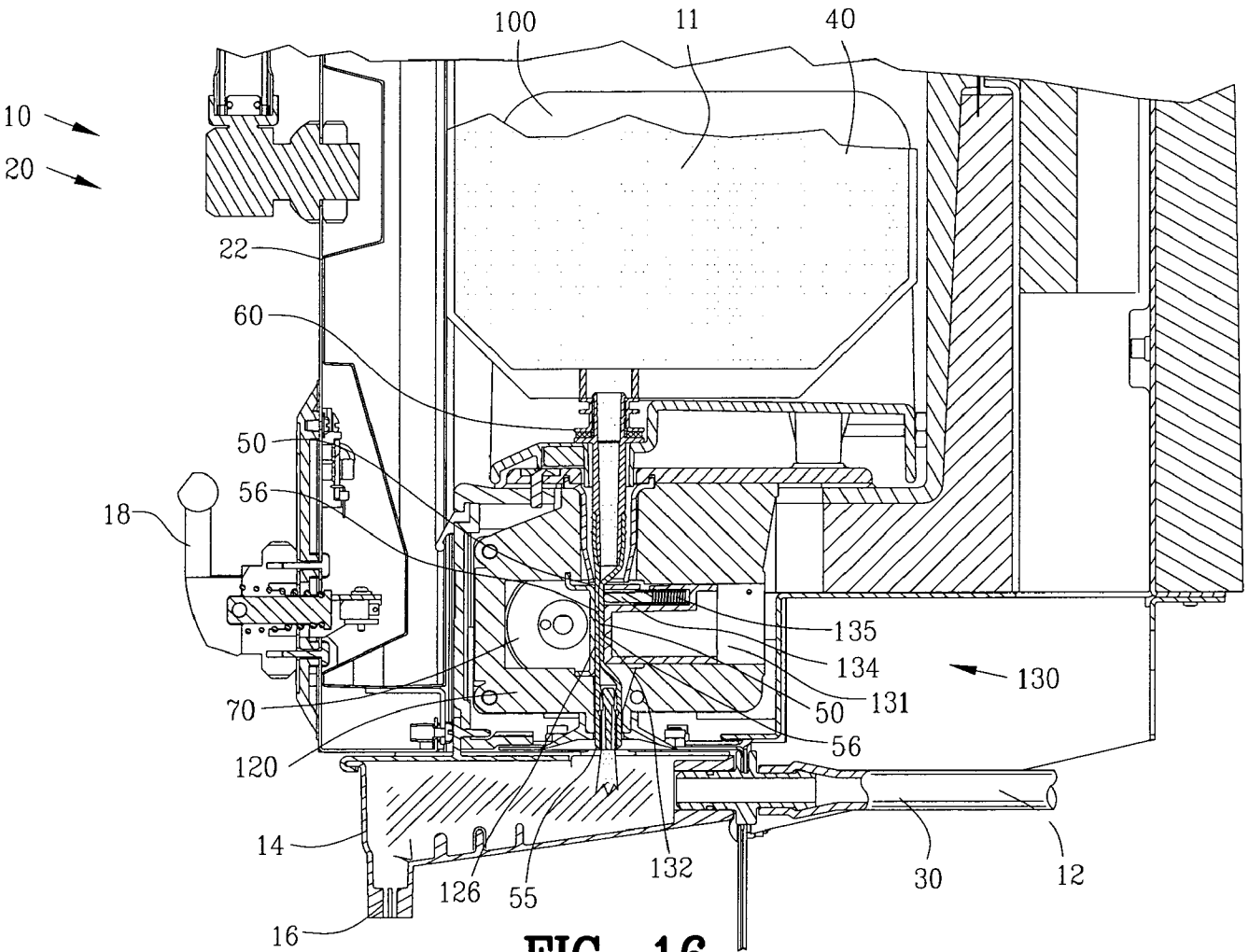
FIG. 16 is a view similar to FIG. 15 with a pumping element collapsing the flexible tube against the compression surface for pumping the liquid from a pressure relief valve.

FIGS. 14-16 illustrate a sequence of pumping of the metering pump 50 shown in FIG. 9. The pump motor 70 drives the pump drive 80 moving the reciprocating member 130 between a retracted position and an extended position.

FIG. 14 illustrates the concentrate container 40 and the metering pump 50 inserted into the pump housing 120. The reciprocating member 130 is shown in the retracted position in FIG. 14. Preferably, the control 90 returns the reciprocating member 130 to the retracted position after a pumping operation. When the reciprocating member 130 is in the retracted position, the metering pump flexible tube 56 may be inserted or removed from the pump housing aperture 123.

FIG. 15 is a view similar to FIG. 14 with the sealing element 134 pinching a metering pump flexible tube 56 for stopping the flow of the liquid concentrate 11. The sealing element 134 is partially withdrawn within the void 136 for pinching the metering pump flexible tube 56 between the sealing element 134 and the compression surface 126 for stopping the flow of the liquid concentrate 11.

FIG. 16 is a view similar to FIG. 15 with the pumping element 133 collapsing the metering pump flexible tube 56 for pumping the liquid concentrate 11. A further movement of the reciprocating member 130 toward the extended position collapses the metering pump flexible tube 56 between the pumping element 133 and the compression surface 126. As the metering pump flexible tube 56 is collapsed, pressure is increased within the metering pump flexible tube 56 below the sealing element 134. When the pressure within the metering pump flexible tube 56 reaches a predetermined level, the pressure relief valve 55 opens for discharging the volume of the first liquid concentrate 11 trapped between the sealing element 134 and the pressure relief valve 55. Upon the discharge of the volume of the liquid concentrate 11 trapped between the sealing element 134 and the pressure relief valve 55, the pressure relief valve 55 closes for the next pumping cycle.

Preferably, the control 90 is a programmable controller for controlling the speed and stroke of the reciprocating member 130. The control of the speed and stroke of the reciprocating member 130 enables the metering pump 50 to be readily altered for different concentrations of the liquid concentrate 11. In the event the concentrate container 40 is provided with a machine-readable indicia indicating the required concentration of the liquid concentrate 11 within the concentrate container 40, the control 90 may automatically change the speed and stroke of the reciprocating member 130 for accommodating the concentration required by the liquid concentrate 11.

Figure 19:
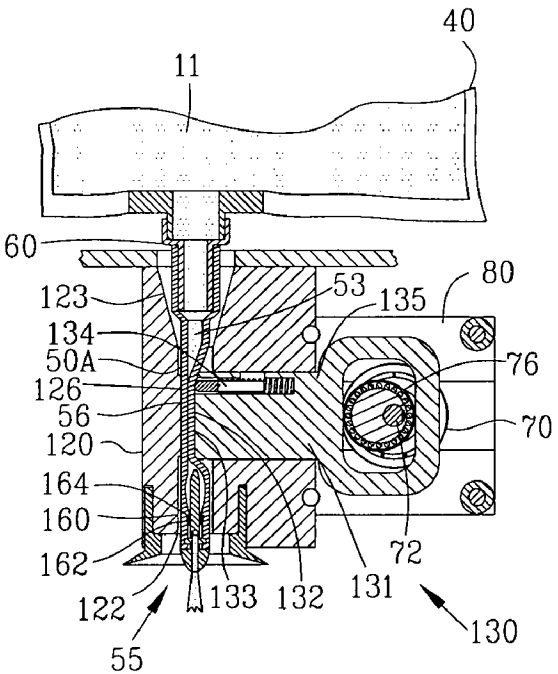
FIG. 19 is a view similar to FIG. 18 with a pumping element collapsing the flexible tube against the compression surface for pumping the liquid from a pressure relief valve.
Figure 18:
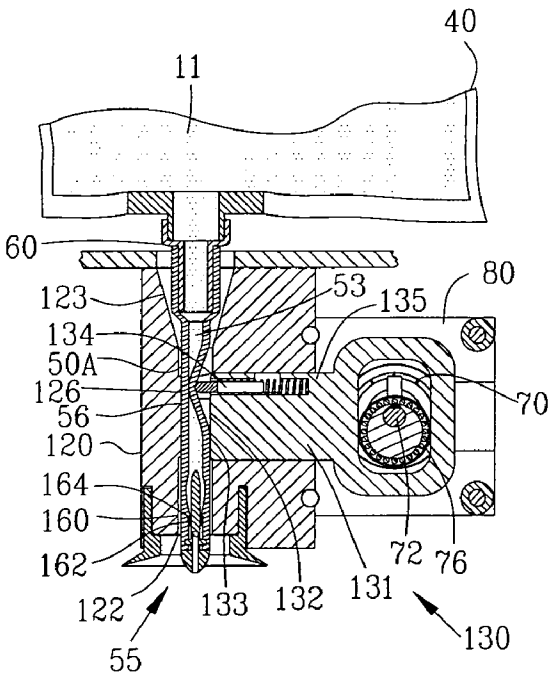
FIG. 18 is a view similar to FIG. 17 with a sealing element pinching a flexible tube against a compression surface.
Figure 17:
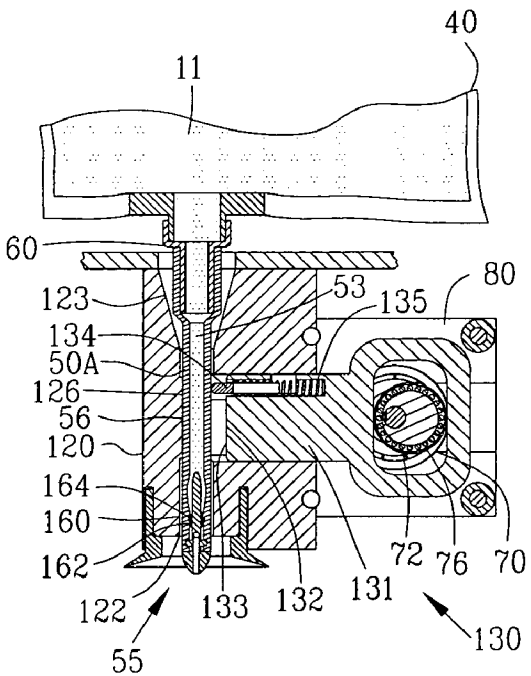
FIG. 17 is a side sectional view of a second embodiment of the motor drive unit.

FIGS. 17-19 illustrate a sequence of pumping utilizing a second embodiment of the motor drive unit 50A. In this example, the pump drive 80 and the reciprocating member 130 has been altered to push the reciprocating member 130 into engagement with the metering pump flexible tube 56. In contrast, the pump drive 80 and the reciprocating member 130 shown in FIGS. 10-16 pulls the reciprocating member 130 into engagement with the metering pump flexible tube 56.

FIG. 17 illustrates the reciprocating member 130 in the retracted position.

FIG. 18 is a view similar to FIG. 17 with a sealing element 134 pinching the metering pump flexible tube 56 against the compression surface 126.

FIG. 19 is a view similar to FIG. 18 with a pumping element 133 collapsing the metering pump flexible tube 56 against the compression surface 126 for pumping the liquid concentrate 11 from a pressure relief valve 55.

Figure 22:
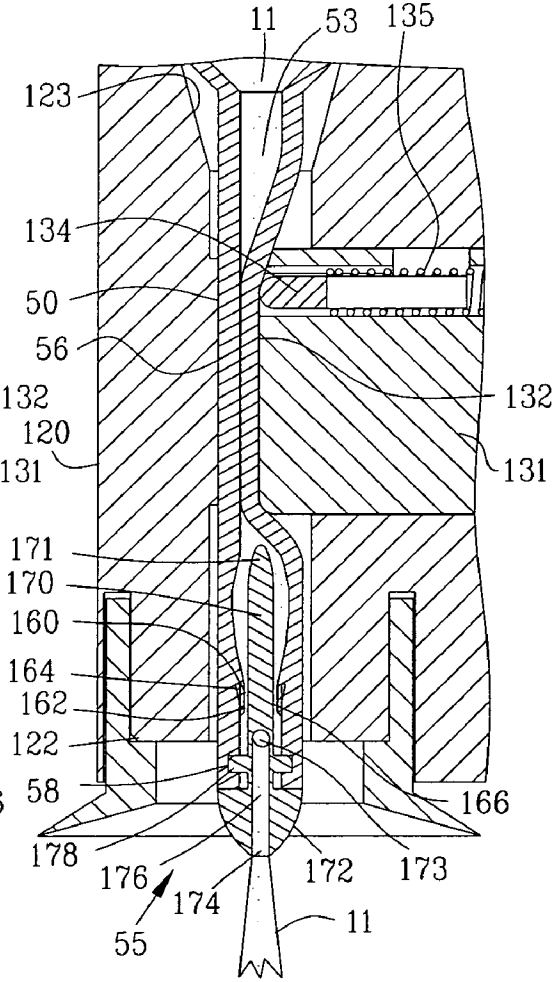
FIG. 22 is a magnified view of FIG. 19.
Figure 21:
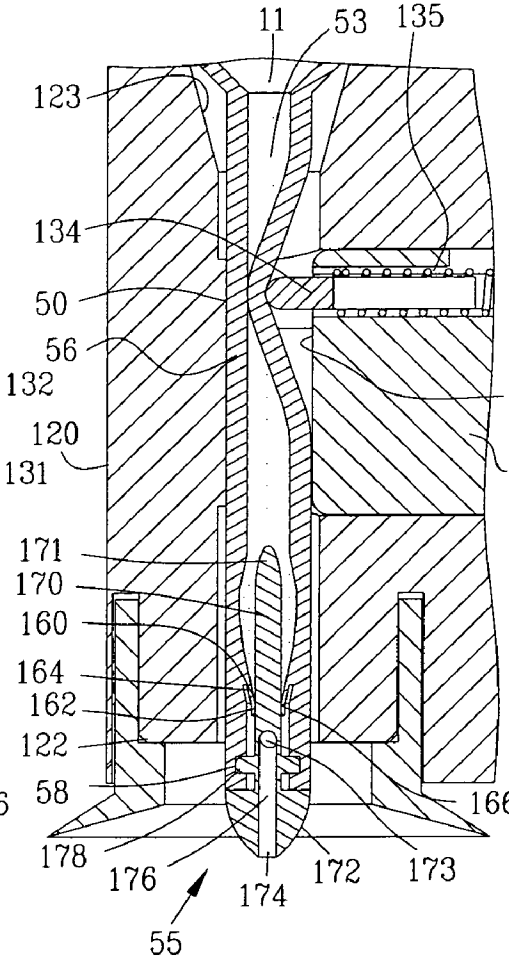
FIG. 21 is a magnified view of FIG. 18.
Figure 20:
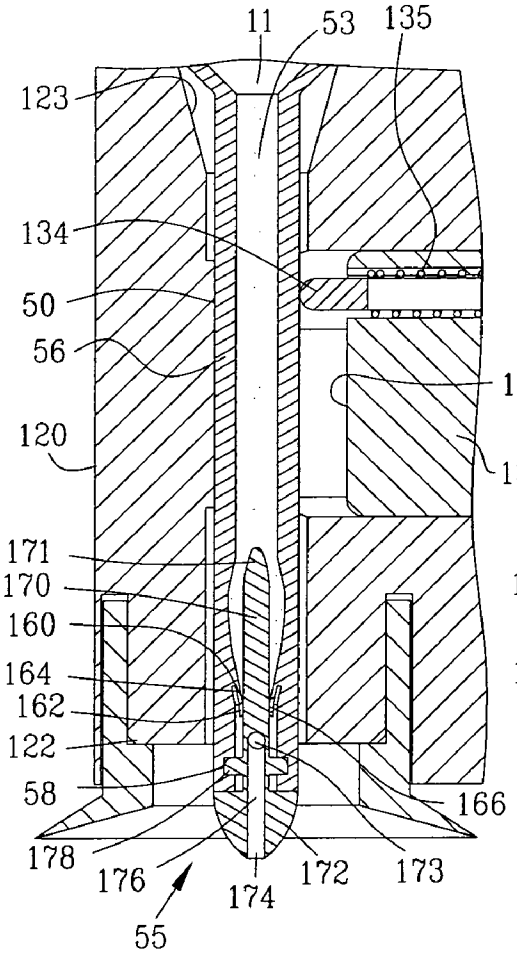
FIG. 20 is a magnified view of FIG. 17.

FIGS. 20-22 are magnified views of FIGS. 17-19 illustrating the sequence of pumping of the metering pump 50A. The pressure relief valve 55 includes a valve element 161, a deformable biasing element 164 and a valve seat 166. The deformable biasing element 164 urges the valve element 162 into engagement with the valve seat 166 for closing the pressure relief valve 55.

An insert 170 extends between a first and a second end 171 and 172. The insert 170 includes an insert input orifice 173 and an insert output orifice 174 interconnected by an insert passageway 176. An insert projection 178 extends radially outwardly from the insert 170. Preferably, the insert 170 is molded from a rigid polymeric material for insertion within the internal duct 53 of the flexible metering pump tube 56. Upon insertion of the insert 170 within the internal duct 53 of the flexible metering pump tube 56, the insert projection 178 engages with a flexible tube recess 58 within the flexible metering pump tube 56 to maintain the position of the insert within the flexible metering pump tube 56.

In this example, the valve element 162 is integrally formed with the deformable biasing element 164 during the molding of the flexible metering pump tube 56. The insert 170 functions as the valve seat 166.

As best shown in FIG. 22, the pressure relief valve 55 includes a deformed annular shaped valve element 162 biased into engagement with the valve seat 166. When the pressure within the metering pump flexible tube 56 exceeds the biasing force of the deformable biasing element 164, the annular shaped valve element 162 is deformable radially outwardly for opening the pressure relief valve 55.

Figure 25:
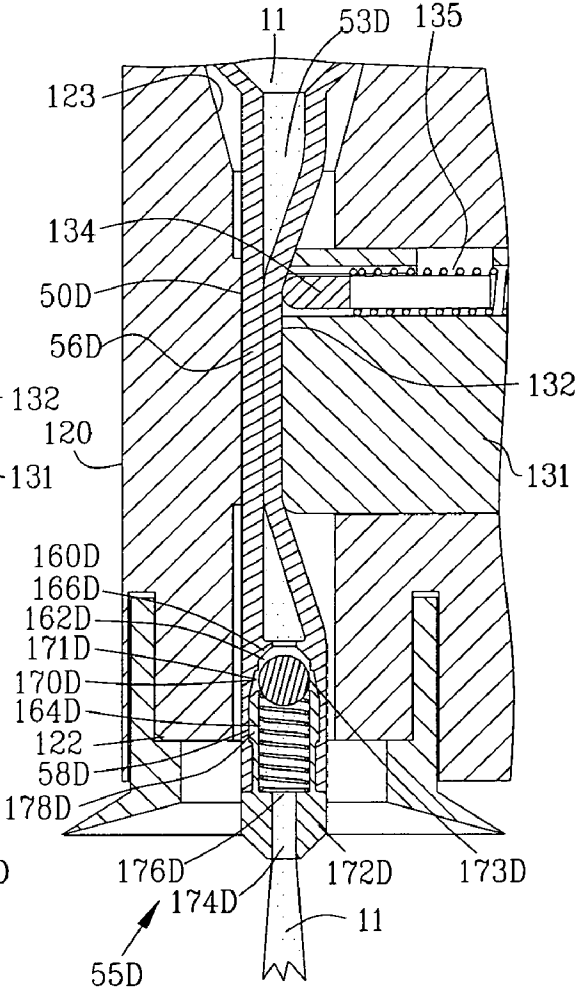
FIG. 25 is a view similar to FIG. 24 with a pumping element collapsing the flexible tube against the compression surface for pumping the liquid from a pressure relief valve.
Figure 24:
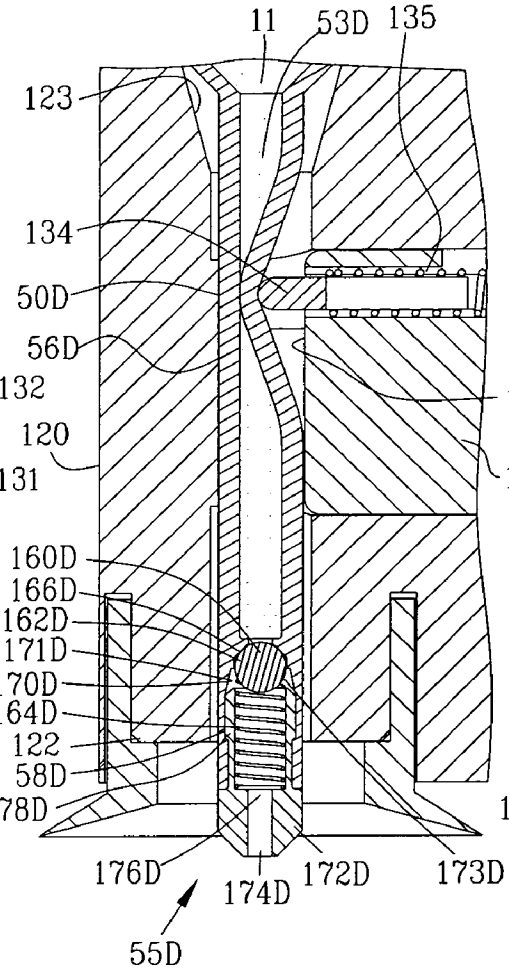
FIG. 24 is a view similar to FIG. 23 with a sealing element pinching a flexible tube against a compression surface.
Figure 23:
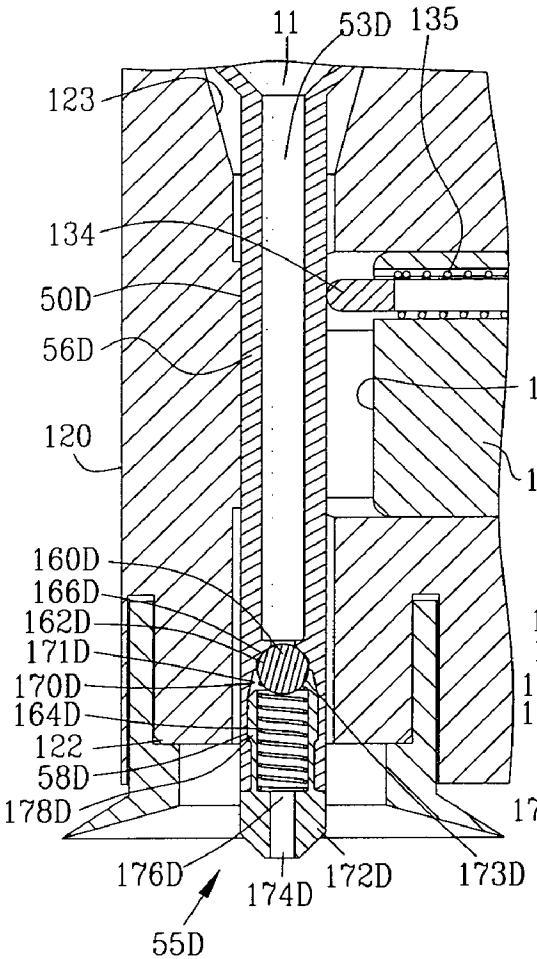
FIG. 23 is a side sectional view of a third embodiment of a metering pump of the present invention.

FIGS. 23-25 illustrate a second embodiment of a pressure relief valve 55D. The pressure relief valve 55D includes a valve element 162D, a deformable biasing element 164D and a valve seat 166D. The deformable biasing element 164D urges the valve element 162D into engagement with the valve seat 166D for closing the pressure relief valve 55D. In this example, the valve seat 166D is integrally formed during the molding of the flexible metering pump tube 56D.

An insert 170D extends between a first and a second end 171D and 172D. The insert 170D includes an insert input orifice 173D and an insert output orifice 174D interconnected by an insert passageway 176D. An insert projection 178D extends radially outwardly from the insert 170D. Preferably, the insert 170D is molded from a rigid polymeric material for insertion within the internal duct 53D of the flexible metering pump tube 56D. Upon insertion of the insert 170D within the internal duct 53D of the flexible metering pump tube 56D, the insert projection 178D engages with a flexible tube recess 58D within the flexible metering pump tube 56D to maintain the position of the insert within the flexible metering pump tube 56D.

As best shown in FIG. 25, the pressure relief valve 55D includes a ball valve element 162D biased into engagement with the valve seat 166D by a coil spring 164D. The insert 170D holds the coil spring 164D in place for enabling the ball valve element 162D to be biased into engagement with the valve seat 166D.

When the pressure within the metering pump flexible tube 56D exceeds the biasing force of the deformable spring biasing element 164D, the ball valve element 164D is displaced from the valve seat 166D for opening the pressure relief valve 55D.

Figure 28:
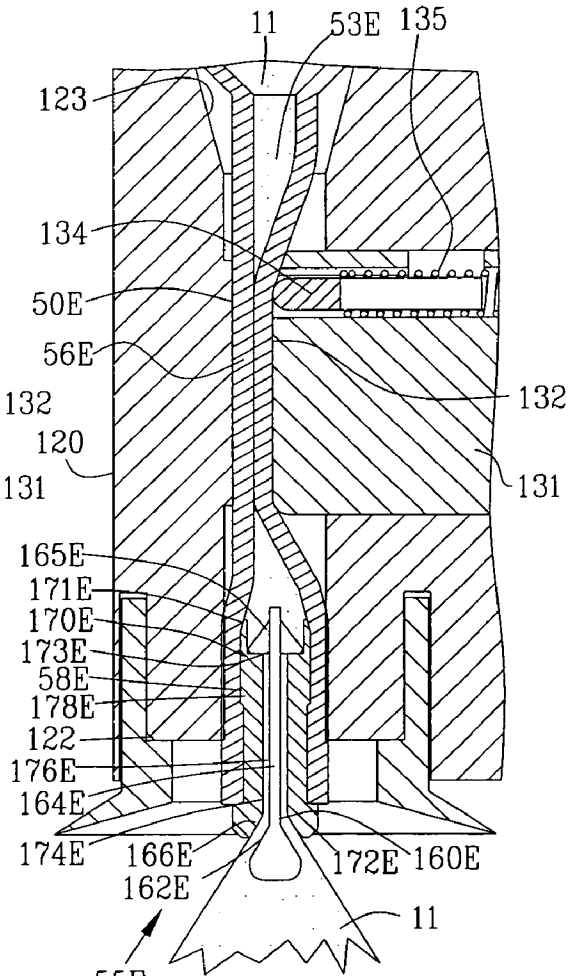
FIG. 28 is a view similar to FIG. 27 with a pumping element collapsing the flexible tube against the compression surface for pumping the liquid from a pressure relief valve.
Figure 27:
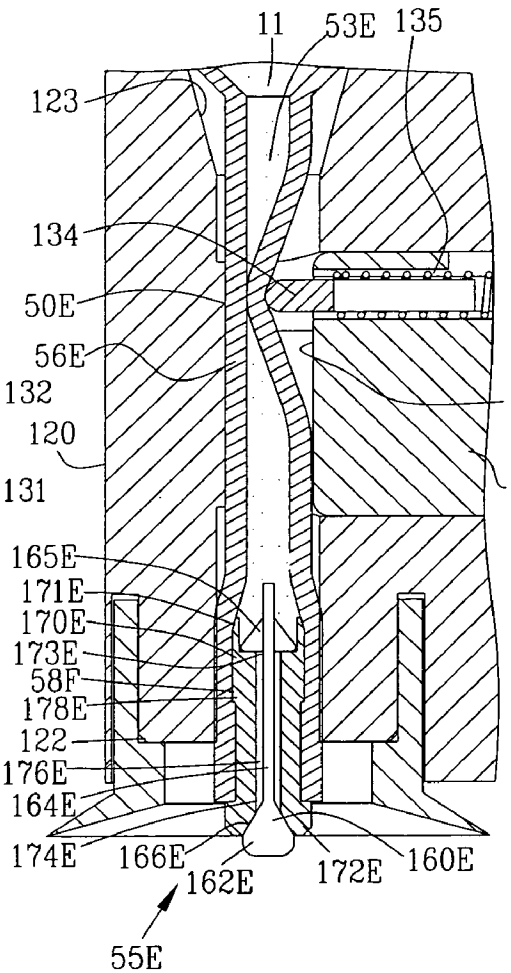
FIG. 27 is a view similar to FIG. 26 with a sealing element pinching a flexible tube against a compression surface.
Figure 26:
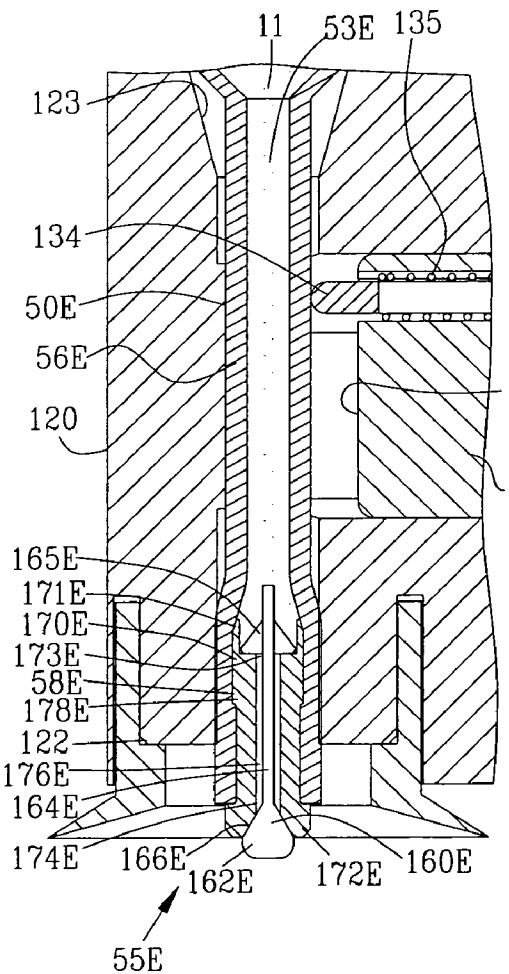
FIG. 26 is a side sectional view of a fourth embodiment of a metering pump of the present invention.

FIGS. 26-28 illustrate a third embodiment of a pressure relief valve 55E. The pressure relief valve 55E includes a valve element 162E, a deformable biasing element 164E and a valve seat 166E. The deformable biasing element 164E urges the valve element 162E into engagement with the valve seat 166E for closing the pressure relief valve 55E.

An insert 170E extends between a first and a second end 171E and 172E. The insert 170E includes an insert input orifice 173E and an insert output orifice 174E interconnected by an insert passageway 176E. An insert projection 178E extends radially outwardly from the insert 170E. Preferably, the insert 170E is molded from a rigid polymeric material for insertion within the internal duct 53E of the flexible metering pump tube 56E. Upon insertion of the insert 170 within the internal duct 53E of the flexible metering pump tube 56E, the insert projection 178E engages with a flexible tube recess 58E within the flexible metering pump tube 56E to maintain the position of the insert within the flexible metering pump tube 56E.

In this example, the valve element 162E is integrally formed with the deformable biasing element 164E as a separate resilient member. The deformable biasing element 164E extends through the insert passageway 176E between the first and second ends 171E and 172E of the insert 170E. The second end of the insert 170E functions as the valve seat 166E.

The deformable biasing element 164E is shown as a longitudinally extending deformable biasing element 164E. One end of the deformable biasing element 164E is connected to a stop 165E located at the first end 171E of the insert 170E whereas the other end of the deformable biasing element 164E is connected to the valve element 162E located at the second end 172E of the insert 170E. The stop 165E of the deformable biasing element 164E may be inserted through the insert passageway 176E of the insert 170E.

As best shown in FIG. 28, when the pressure within the metering pump flexible tube 56E exceeds the biasing force of the deformable biasing element 164E, the deformable biasing element 164E is deformed longitudinally for opening the pressure relief valve 55E.

Figure 31:
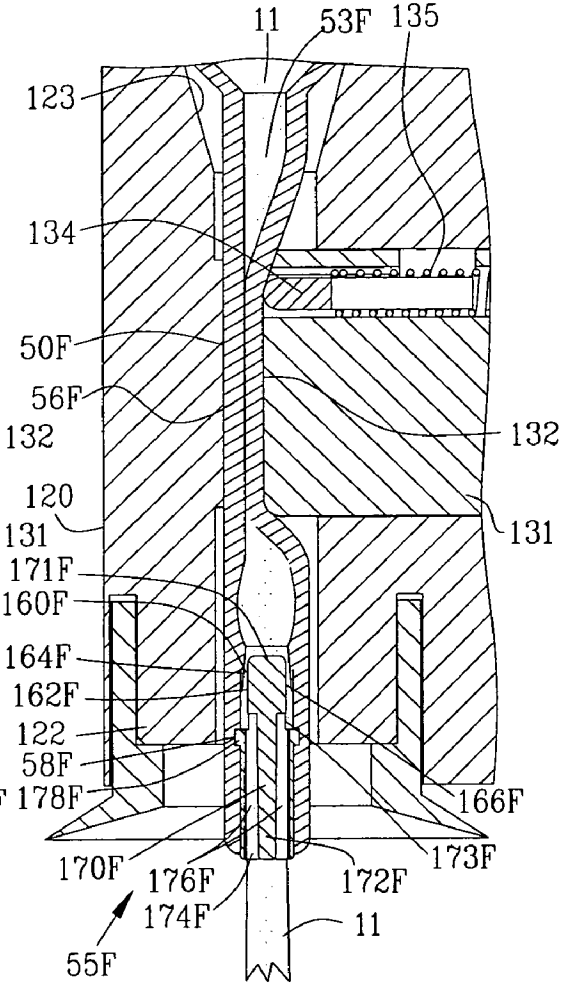
FIG. 31 is a view similar to FIG. 30 with a pumping element collapsing the flexible tube against the compression surface for pumping the liquid from a pressure relief valve.
Figure 30:
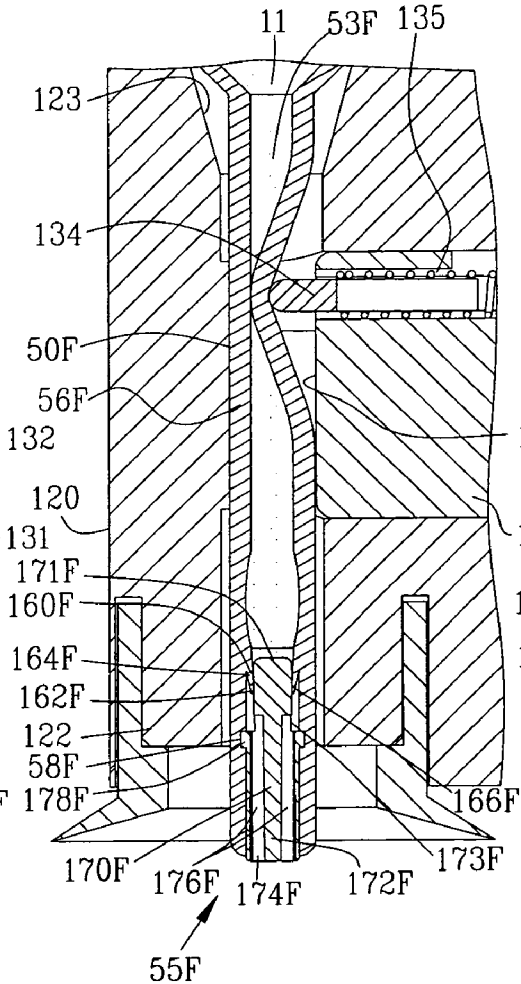
FIG. 30 is a view similar to FIG. 29 with a sealing element pinching a flexible tube against a compression surface.
Figure 29:
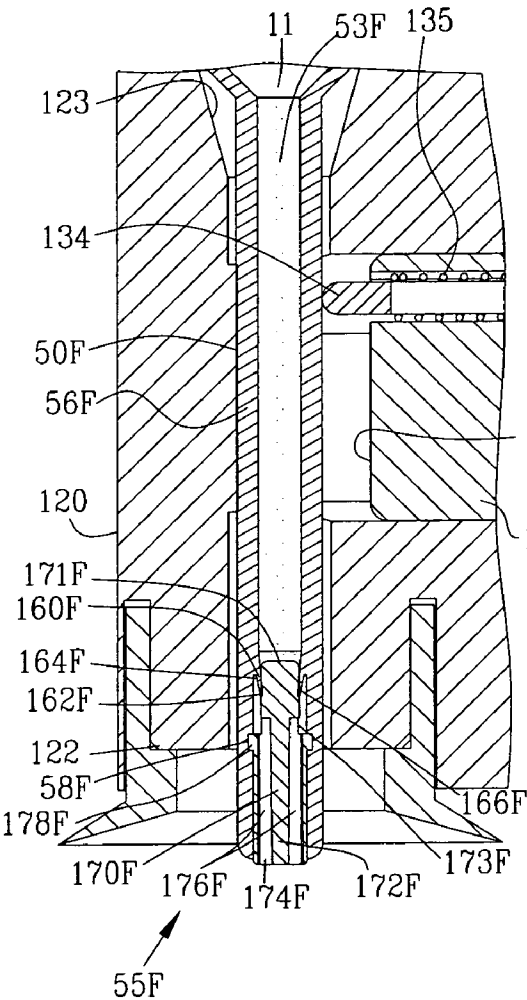
FIG. 29 is a side sectional view of a fifth embodiment of a metering pump of the present invention.

FIGS. 29-31 illustrate a forth embodiment of a pressure relief valve 55F. The pressure relief valve 55F includes a valve element 161F, a deformable biasing element 164E and a valve seat 166F. The deformable biasing element 164F urges the valve element 161F into engagement with the valve seat 166F for closing the pressure relief valve 55F.

An insert 170F extends between a first and a second end 171F and 172F. The insert 170E includes an insert input orifice 173F and an insert output orifice 174F interconnected by an insert passageway 176F. An insert projection 178F extends radially outwardly from the insert 170F. Preferably, the insert 170F is molded from a rigid polymeric material for insertion within the internal duct 53F of the flexible metering pump tube 56F. Upon insertion of the insert 170F within the internal duct 53F of the flexible metering pump tube 56F, the insert projection 178F engages with a flexible tube recess 58F within the flexible metering pump tube 56F to maintain the position of the insert within the flexible metering pump tube 56F.

In this example, the valve element 162F is integrally formed with the deformable biasing element 164F during the molding of the flexible metering pump tube 56F. The insert 170F functions as the valve seat 166F.

As best shown in FIG. 25, the pressure relief valve 55F includes a deformed annular shaped valve element 162F biased into engagement with the valve seat 166F. When the pressure within the metering pump flexible tube 56F exceeds the biasing force of the deformable biasing element 164F, the annular shaped valve element 162F is deformable radially outwardly for opening the pressure relief valve 55F.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A pump for metering a liquid from a container, comprising:

a flexible tube extending between a first and a second tube end with said first tube end connected to the container;

a pressure relief valve located in said flexible tube;

a pump housing having a pump housing aperture for receiving said flexible tube;

a compression surface located adjacent to said pump housing aperture;

a reciprocating member having a pumping element with a void defined in said pumping element;

a sealing element slidably located in said void;

a spring mounted on said pumping element for interacting between said pumping element and said sealing member for urging said sealing element to extend beyond said pumping element;

a drive moving said sealing element for pinching said flexible tube against said compression surface through a compression of said spring upstream from said pressure relief valve for trapping liquid between said sealing element and said pressure relief valve; and said drive moving said pumping element for collapsing said flexible tube against said compression surface for pumping said trapped liquid to discharge a metered quantity of the liquid from said pressure relief valve.

2. A pump for metering a liquid from a container as set forth in claim 1, wherein said pressure relief valve is located in proximity to said second tube end of said flexible tube.

3. A pump for metering a liquid from a container as set forth in claim 1, wherein said pressure relief valve includes a valve element; and a deformable biasing element integrally attached to said valve element for biasing said valve element into a closed position.

4. A pump for metering a liquid from a container as set forth in claim 1, wherein said pressure relief valve includes a valve element; and a longitudinally deformable biasing element integrally attached to said valve element for biasing said valve element into a closed position.

5. A pump for metering a liquid from a container as set forth in claim 1, wherein said pressure relief valve includes a deformed annular shaped valve element biased in a closed position; and said annular shaped valve element being deformable radially outwardly for opening said pressure relief valve.

6. A pump for metering a liquid from a container as set forth in claim 1, wherein said pressure relief valve includes a ball valve element; and a biasing spring for biasing said ball valve element into a closed position.

7. A pump for metering a liquid from a container as set forth in claim 1, wherein reciprocating member is slidably mounted within said pump housing.

8. A pump for metering a liquid from a container as set forth in claim 1, wherein said pumping element is fixed relative to said reciprocating member.

9. A pump for metering a liquid from a container as set forth in claim 1, including a motor cooperating with a scotch yoke for moving said reciprocating member within said pump housing.

10. A pump for metering a liquid from a collapsible container, comprising:

a flexible tube extending between a first and a second tube end with said first tube end connected to the collapsible container;

a pressure relief valve located in proximity to said second tube end of said flexible tube;

a pump housing having a pump housing aperture for receiving said second tube end of said flexible tube;

a substantially planar compression surface located adjacent to said aperture;

a reciprocating member slidably mounted within said pump housing to move between a retracted position and an extended position;

a pumping element fixed to said reciprocating member;

a void defined in said pumping element;

a sealing element slidably located in said void;

a spring mounted on said pumping element for interacting between said pumping element and said sealing member for urging said sealing element to extend beyond said pumping element;

a drive moving said reciprocating member from said retracted position toward said extended position enabling said sealing element to pinch said flexible tube between said sealing element and said substantially planar compression surface through a compression of said spring for trapping liquid between the sealing element and said pressure relief valve; and said drive further moving said reciprocating member toward said extended position for collapsing said flexible tube between said pumping element and said substantially planar compression surface for discharging the trapped liquid through said pressure relief valve for pumping a metered quantity of the liquid.

11. A pump drive for driving a metering pump including a flexible tube having a pressure relief valve connected to a source of a liquid; comprising:

an electric motor having a rotary drive defining a rotary drive axis;

a drive roller secured to said rotary drive and located offset from said rotary drive axis;

a yoke having a generally rectangular yoke aperture for cooperating with said drive roller for providing a reciprocating motion to said yoke upon a rotary motion of said electric motor;

a pump housing having a pump housing aperture for receiving said flexible tube;

a cylindrical bore extending perpendicular to said pump housing aperture;

a reciprocating member comprising a piston slidably disposed within said cylindrical bore;

said yoke connected to said piston for reciprocating said piston within said cylindrical bore upon a rotary motion of said electric motor;

said piston having a piston end wall for defining a pumping element;

a void extending into said piston from said piston end wall;

a sealing element slidably disposed within said void in said piston;

a spring mounted on said pumping element for interacting between said pumping element and said sealing member for urging said sealing element to extend beyond said piston end wall of said piston;

said electric motor moving said sealing element and said piston with said sealing element pinching the flexible tube through a compression of said spring for trapping liquid between said sealing element and said pressure relief valve; and said electric motor moving said pumping element of said piston for collapsing said flexible tube for pumping said trapped liquid to discharge a metered quantity of the liquid from said pressure relief valve.

12. A pump drive for driving a metering pump as set forth in claim 11, wherein said yoke integrally formed with said piston.

13. A pump drive for driving a metering pump as set forth in claim 11, including a position sensor aperture extending through said pump housing and disposed transverse to said cylindrical bore; and a light emitting device located at one end of said position sensor aperture cooperating with a light sensing device located at the other end of said position sensor aperture for sensing when said piston interrupts said position sensor aperture.

14. A pump drive for driving a metering pump as set forth in claim 11, including a sold out sensor aperture extending through said pump housing and disposed transverse to said pump housing aperture; and a light emitting device located at one end of said sold out sensor aperture cooperating with a light sensing device located at the other end of said sold out sensor aperture for sensing an absence of the liquid within said pump housing aperture.

15. A control for a pump drive for driving a metering pump including a flexible tube having a pressure relief valve connected to a source of a liquid, comprising:

a pump housing having a pump housing aperture for receiving said flexible tube;

a compression surface located adjacent to said pump housing aperture;

a reciprocating member having a pumping element with a void defined in said dumping element;

sealing element slidably located in said void;

a spring mounted on said pumping element for interacting between said pumping element and said sealing member for urging said sealing element to extend beyond said pumping element;

an electric motor moving said sealing element of said reciprocating member for pinching said flexible tube through a compression of said spring for trapping liquid between said sealing element and said pressure relief valve;

said electric motor moving said pumping element of said reciprocating member for collapsing said flexible tube for pumping said trapped liquid to discharge a metered quantity of the liquid from said pressure relief valve; and an electronic control connected to said electric motor for moving said reciprocating member a selected number of times for metering a desired quantity of the liquid.

* * * * *